US009354599B2

(12) United States Patent
Hashimoto et al.

(10) Patent No.: US 9,354,599 B2
(45) Date of Patent: May 31, 2016

(54) DRUM UNIT CAPABLE OF GROUNDING PHOTOSENSITIVE DRUM AND CLEANING MEMBER

(71) Applicant: BROTHER KOGYO KABUSHIKI KAISHA, Nagoya, Aichi (JP)

(72) Inventors: Junichi Hashimoto, Toyohashi (JP); Ryuya Yamazaki, Nagoya (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 14/670,520

(22) Filed: Mar. 27, 2015

(65) Prior Publication Data

US 2015/0277349 A1 Oct. 1, 2015

(30) Foreign Application Priority Data

Mar. 31, 2014 (JP) ..... 2014-073247

(51) Int. Cl.
*G03G 21/16* (2006.01)
*G03G 21/18* (2006.01)

(52) U.S. Cl.
CPC ..... *G03G 21/169* (2013.01); *G03G 21/1619* (2013.01); *G03G 21/1652* (2013.01); *G03G 21/1867* (2013.01)

(58) Field of Classification Search
CPC ..... G03G 15/80; G03G 21/0029; G03G 21/1619; G03G 21/1652; G03G 21/1867
See application file for complete search history.

(56) References Cited

U.S. PATENT DOCUMENTS

2010/0135689 A1* 6/2010 Abe ..... G03G 21/1867 399/90
2011/0064462 A1 3/2011 Abe et al.

FOREIGN PATENT DOCUMENTS

JP 2011-064884 A 3/2011

* cited by examiner

*Primary Examiner* — Erika J Villaluna
(74) *Attorney, Agent, or Firm* — Scully, Scott, Murphy & Presser, P.C.

(57) ABSTRACT

A drum unit includes: a photosensitive drum; a side plate; a cleaning member; a support member; a frame; and a connecting member. The photosensitive drum has an axis extending in an axial direction. The photosensitive drum has a surface. The side plate has electrical conductive properties. The side plate is configured to support the photosensitive drum. The side plate includes a contact portion configured to contact an external member having electrical conductive properties. The cleaning member is configured to clean the surface of the photosensitive drum. The support member has electrical conductive properties and is configured to support the cleaning member. The frame has electrical insulating properties. The frame is configured to support the support member and fixed to the side plate. The connecting member is configured to electrically connect the support member to the side plate.

15 Claims, 13 Drawing Sheets

DRUM UNIT CAPABLE OF GROUNDING PHOTOSENSITIVE DRUM AND CLEANING MEMBER

CROSS REFERENCE TO RELATED APPLICATION

This application claims priority from Japanese Patent Application No. 2014-073247 filed Mar. 31, 2014. The entire content of the priority application is incorporated herein by reference.

TECHNICAL FIELD

The present disclosure relates to a drum unit mounted in an image forming apparatus that employs an electrophotographic system.

BACKGROUND

As an electrophotographic image forming apparatus, there is known a tandem-type color printer that includes a plurality of image carriers corresponding to respective colors of yellow, magenta, cyan, and black.

As such a tandem-type color printer, there is proposed a printer provided with a drum unit including four photosensitive drums that correspond to the respective four colors, bearing members that support the respective photosensitive drums, and inner side plates that position the respective photosensitive drums by integrally supporting the photosensitive drums through the bearing members.

SUMMARY

In the printer described above, it is proposed that the photosensitive drums and cleaning members that clean the photosensitive drums are grounded to a main casing.

In view of the foregoing, it is an object of the disclosure to provide a drum unit capable of grounding a photosensitive drum and a cleaning member with a simple configuration.

In order to attain the above and other objects, according to one aspect, the disclosure provides a drum unit including: a photosensitive drum; a side plate; a cleaning member; a support member; a frame; and a connecting member. The photosensitive drum has an axis extending in an axial direction. The photosensitive drum has a surface. The side plate has electrical conductive properties. The side plate is configured to support the photosensitive drum. The side plate includes a contact portion configured to contact an external member having electrical conductive properties. The cleaning member is configured to clean the surface of the photosensitive drum. The support member has electrical conductive properties and is configured to support the cleaning member. The frame has electrical insulating properties. The frame is configured to support the support member and fixed to the side plate. The connecting member is configured to electrically connect the support member to the side plate.

According to another aspect, the disclosure provides a drum unit including: a first photosensitive drum; a second photosensitive drum; a first side plate; a second side plate; a first cleaning member; a second cleaning member; a first support member; a second support member; a frame; a first connecting member; a second connecting member; a third connecting member; and a fourth connecting member. The first photosensitive drum has a first axis extending in an axial direction. The first photosensitive drum has a first surface. The second photosensitive drum has a second axis extending in the axial direction. The second photosensitive drum has a second surface. The first side plate has electrical conductive properties. The first side plate is configured to support the first and second photosensitive drums. The first side plate includes a first contact portion configured to contact an external member having electrical conductive properties. The second side plate has electrical conductive properties. The second side plate is configured to support the first and second photosensitive drums. The second side plate including a second contact portion configured to contact the external member. The first cleaning member is configured to clean the first surface of the first photosensitive drum. The second cleaning member is configured to clean the second surface of the second photosensitive drum. The first support member has electrical conductive properties and is configured to support the first cleaning member. The second support member has electrical conductive properties and is configured to support the second cleaning member. The frame has electrical insulating properties. The frame is configured to support both the first support member and the second support member. The frame is fixed to the first side plate and the second side plate. The first connecting member is configured to electrically connect the first support member to the first side plate. The second connecting member is configured to electrically connect the first support member to the second side plate. The third connecting member is configured to electrically connect the second support member to the first side plate. The fourth connecting member is configured to electrically connect the second support member to the second side plate.

According to still another aspect, the disclosure provides a drum unit including: a photosensitive drum; a first side plate; a second side plate; and a conducting member. The photosensitive drum has an axis extending in an axial direction. The photosensitive drum has a first axial end portion and a second axial end portion opposite to the first axial end portion in the axial direction. The first side plate has electrical conductive properties. The first side plate is configured to support the first axial end portion of the photosensitive drum and configured to be electrically connected to the photosensitive drum. The first side plate includes a first contact portion configured to contact an external member having electrical conductive properties. The second side plate has electrical conductive properties. The second side plate is configured to support the second axial end portion of the photosensitive drum and configured to be electrically disconnected from the photosensitive drum. The second side plate includes a second contact portion configured to contact the external member. The conducting member is disposed adjacent to the photosensitive drum and configured to electrically connect the first side plate and the second side plate.

DETAILED DESCRIPTION

Figure 1:
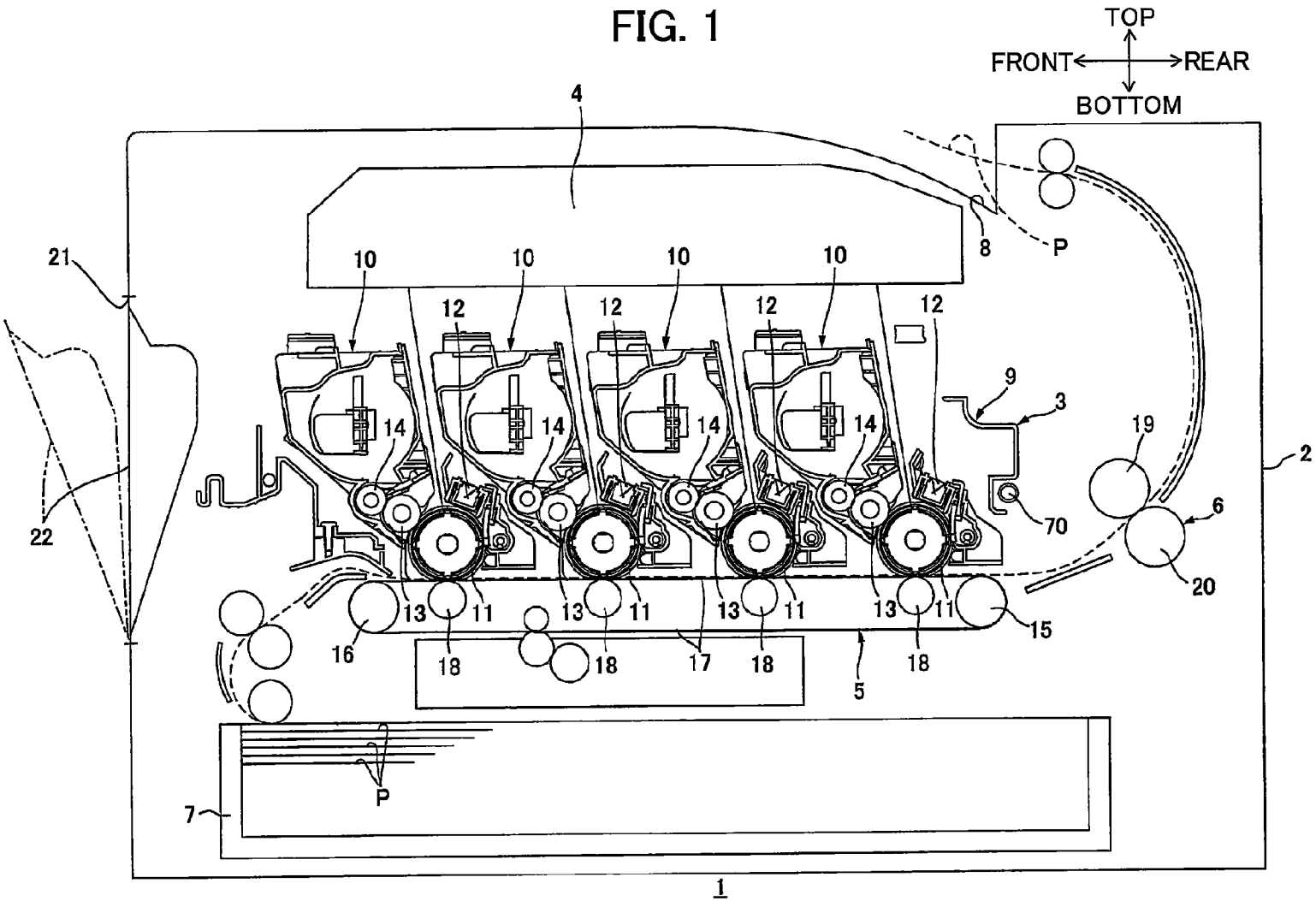
FIG. 1 is a center cross-sectional view of an image forming apparatus according to one embodiment.

1. Overall Structure of Image Forming Apparatus

An image forming apparatus 1 in which a drum unit according to one embodiment is detachably mountable will be described with reference to FIG. 1, wherein like parts and components are designated by the same reference numerals to avoid duplicating description.

As illustrated in FIG. 1, the image forming apparatus 1 is a horizontal direct tandem-type color laser printer.

Directions in the following description related to the image forming apparatus 1 will be given based on a state of the image forming apparatus 1 when the image forming apparatus 1 is resting on a level surface. Specifically, the top side and the bottom side in FIG. 1 will be referred to as the top side and the bottom side of the image forming apparatus 1, respectively. Further, the left side and the right side in FIG. 1 will be referred to as the front side and the rear side of the image forming apparatus 1, respectively. Further, the left side and the right side of the image forming apparatus 1 will be based on the reference point of an operator viewing the image forming apparatus 1 from the front side. Specifically, the near side and the far side in FIG. 1 will be referred to as the right side and the left side of the image forming apparatus 1, respectively.

The image forming apparatus 1 includes a main casing 2, a process unit 3, a scanner unit 4, a transfer unit 5, and a fixing unit 6.

The main casing 2 is formed in a general box-like shape. The main casing 2 includes an access opening 21, a front cover 22, a supply tray 7, and a discharge tray 8.

The access opening 21 is formed in a front side of the main casing 2. The access opening 21 provides communication between the interior and exterior of the main casing 2 and allows the process unit 3 to pass therethrough.

The front cover 22 is provided on the front side of the main casing 2. The front cover 22 has a general flat plate shape. The front cover 22 extends vertically when in its closed position. The front cover 22 is supported to a front wall of the main casing 2 and is capable of pivotally moving about its bottom end. The front cover 22 is adapted to open and close over the access opening 21.

The supply tray 7 is disposed at a bottom section of the main casing 2. The supply tray 7 is adapted to accommodate sheets P of paper.

The discharge tray 8 is disposed on a top wall of the main casing 2. The discharge tray 8 is recessed downward from a top surface of the main casing 2 in order to receive the sheets P.

The process unit 3 is disposed in an approximate center region of the main casing 2. The process unit 3 is movable between a position outside the man casing 2 and a position inside the main casing 2 through the access opening 21 when the front cover 22 is opened. The process unit 3 includes a drum unit 9 and a plurality of developing cartridges 10.

The drum unit 9 includes a plurality of photosensitive drums 11 and a plurality of scorotron chargers 12.

Each of the plurality of photosensitive drums 11 is rotatably supported in a lower end portion of the process unit 3. The plurality of photosensitive drums 11 respectively correspond to four colors, i.e., yellow, magenta, cyan, and black. The plurality of photosensitive drums 11 are arranged juxtaposed with each other and spaced at intervals in order of yellow, magenta, cyan, and black from the front side to the rear side of the main casing 2. That is, the plurality of photosensitive drums 11 are arrayed in a front-rear direction. The front-rear direction is an example of a perpendicular direction. Each of the plurality of photosensitive drums 11 has a generally cylindrical shape with its axis oriented in a left-right direction. That is, an axis A (see FIG. 5) of the photosensitive drums 11 is oriented in the left-right direction. The left-right direction is an example of an axial direction. One of the plurality of photosensitive drums 11 is an example of a first photosensitive drum, and another of the plurality of photosensitive drums 11 is an example of a second photosensitive drum.

The plurality of scorotron chargers 12 respectively correspond to the plurality of photosensitive drums 11, and are disposed diagonally above and rearward of the corresponding photosensitive drums 11 with a gap therebetween.

The plurality of developing cartridges 10 respectively correspond to the plurality of photosensitive drums 11, and are disposed above the corresponding photosensitive drums 11. Each of the plurality of developing cartridges 10 includes a developing roller 13 and a supply roller 14. Further, each of the plurality of developing cartridges 10 has an internal space above the developing roller 13 and the supply roller 14 for accommodating a toner in a corresponding color.

The developing roller 13 is rotatably supported in a lower end portion of the corresponding developing cartridge 10 such that its outer circumferential surface is exposed on the rear side of the developing cartridge 10. The developing roller 13 is positioned to contact an upper front surface of the corresponding photosensitive drum 11.

The supply roller 14 is disposed diagonally above and forward of the corresponding developing roller 13. The supply roller 14 contacts an upper front surface of the corresponding developing roller 13.

The scanner unit 4 is disposed above the process unit 3. As indicated by solid lines of FIG. 1, the scanner unit 4 irradiates laser beams based on image data toward the photosensitive drums 11, exposing the photosensitive drums 11.

The transfer unit 5 is disposed below the process unit 3. The transfer unit 5 includes a drive roller 15, a driven roller 16, a conveyor belt 17, and a plurality of transfer rollers 18.

The drive roller 15 is disposed at a rear end of the transfer unit 5.

The driven roller 16 is disposed at a front end of the transfer unit 5 at a position opposing but spaced apart from the drive roller 15.

The conveyor belt 17 is looped around the drive roller 15 and the driven roller 16 such that an upper portion thereof contacts all of the photosensitive drums 11. The conveyor belt 17 moves in a circulating manner as the drive roller 15 is driven and the driven roller 16 follows such that the upper portion of the conveyor belt 17 moves from the front side toward the rear side.

The plurality of transfer rollers 18 are respectively provided to correspond to the plurality of photosensitive drums 11, and are disposed below the corresponding photosensitive drums 11 with the upper portion of the conveyor belt 17 interposed therebetween.

The fixing unit 6 is disposed to the rear of the transfer unit 5. The fixing unit 6 includes a heating roller 19, and a pressure roller 20 that contacts the heating roller 19.

When the image forming apparatus 1 starts an image forming operation, the scorotron chargers 12 applies a uniform charge to the surfaces of the corresponding photosensitive drums 11. Subsequently, the scanner unit 4 exposes the surfaces of the photosensitive drums 11, forming electrostatic latent images based on image data on the surfaces of the photosensitive drums 11.

In the meantime, the supply rollers 14 supply toner from the corresponding developing cartridges 10 to the corresponding developing rollers 13. At this time, the toner is tribocharged between the developing rollers 13 and the corresponding supply rollers 14, and hence the charged toner is carried on the developing rollers 13.

Next, the developing rollers 13 supply the toner carried thereon to the electrostatic latent images formed on the surfaces of the corresponding photosensitive drums 11, producing toner images on the surfaces of the photosensitive drums 11.

Various rollers in the image forming apparatus 1 are rotated to convey the sheets P from the supply tray 7 along a path that first follows an upward-forward direction then an upward-rearward direction, and supply the sheets P one sheet at a time between the forwardmost (i.e. yellow) photosensitive drum 11 and the conveyor belt 17 at a prescribed timing. Subsequently, the conveyor belt 17 conveys the sheet P in a direction from its front side to its rear side. As the sheet P passes between each photosensitive drum 11 and the corresponding transfer roller 18, the toner image on the photosensitive drum 11 is transferred onto the sheet P.

Subsequently, the heating roller 19 and the pressing roller 20 apply heat and pressure to the sheet P as the sheet P passes therebetween. At this time, the toner image is thermally fixed onto the sheet P. Thereafter, the sheet P is discharged to the discharge tray 8.

2. Detailed Structure of Drum Unit

Figure 2:
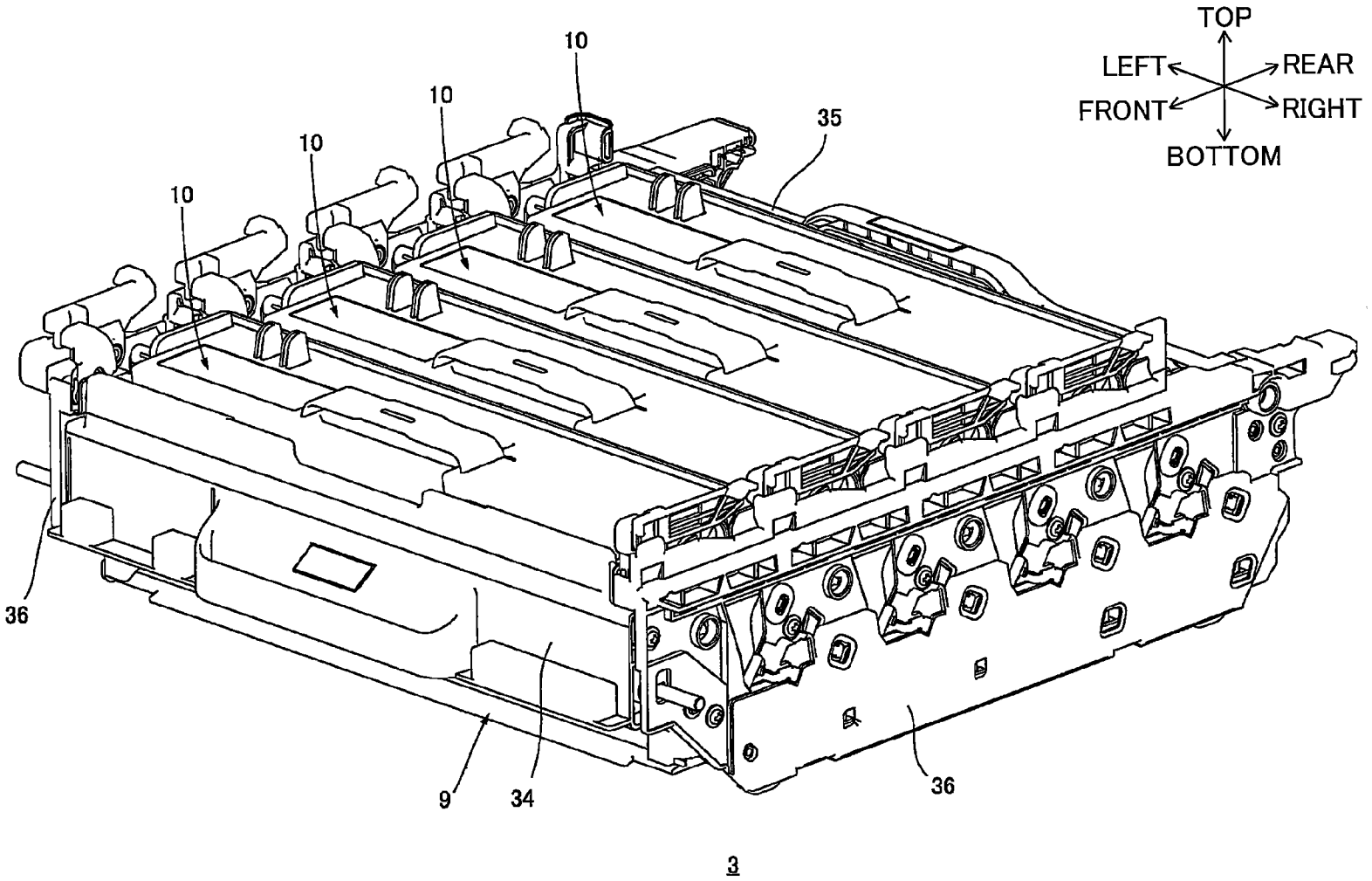
FIG. 2 is a perspective view of a process unit provided in the image forming apparatus in FIG. 1 as viewed from an upper front right side thereof.
Figure 3:
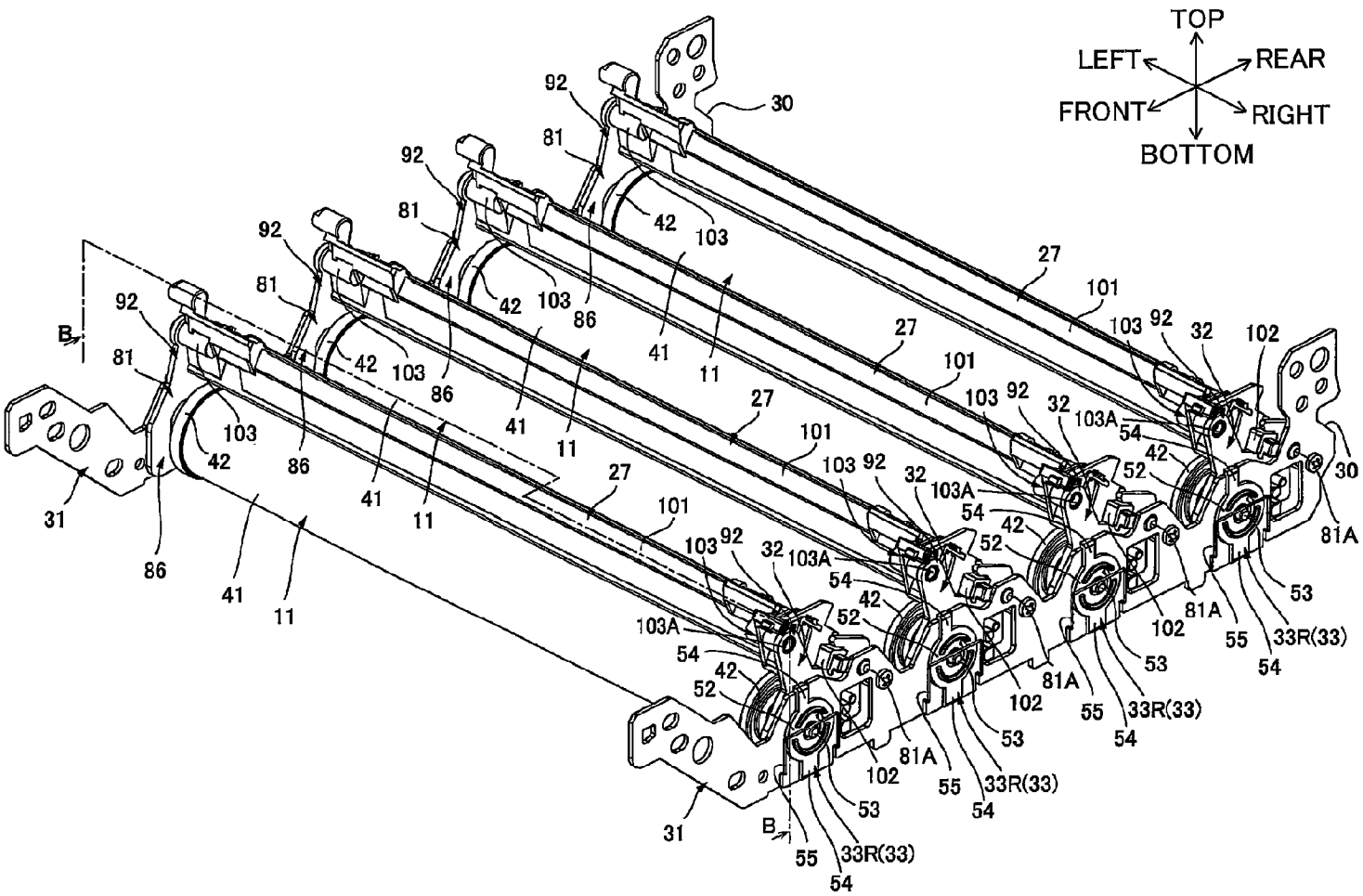
FIG. 3 is a perspective view of a drum unit provided in the process unit in FIG. 2 as viewed from an upper front right side thereof, in which a front plate, a rear plate and a pair of outer side plates are removed.

As illustrated in FIGS. 2 and 3, the drum unit 9 has a general rectangular frame shape in a plan view. The drum unit 9 includes a pair of inner side plates 31, a plurality of drum cleaners 32, a plurality of charging units 27, the plurality of photosensitive drums 11 described above, a plurality of bearing members 33, a front plate 34, a rear plate 35, and a pair of outer side plates 36.

(1) Inner Side Plate

Figure 5:
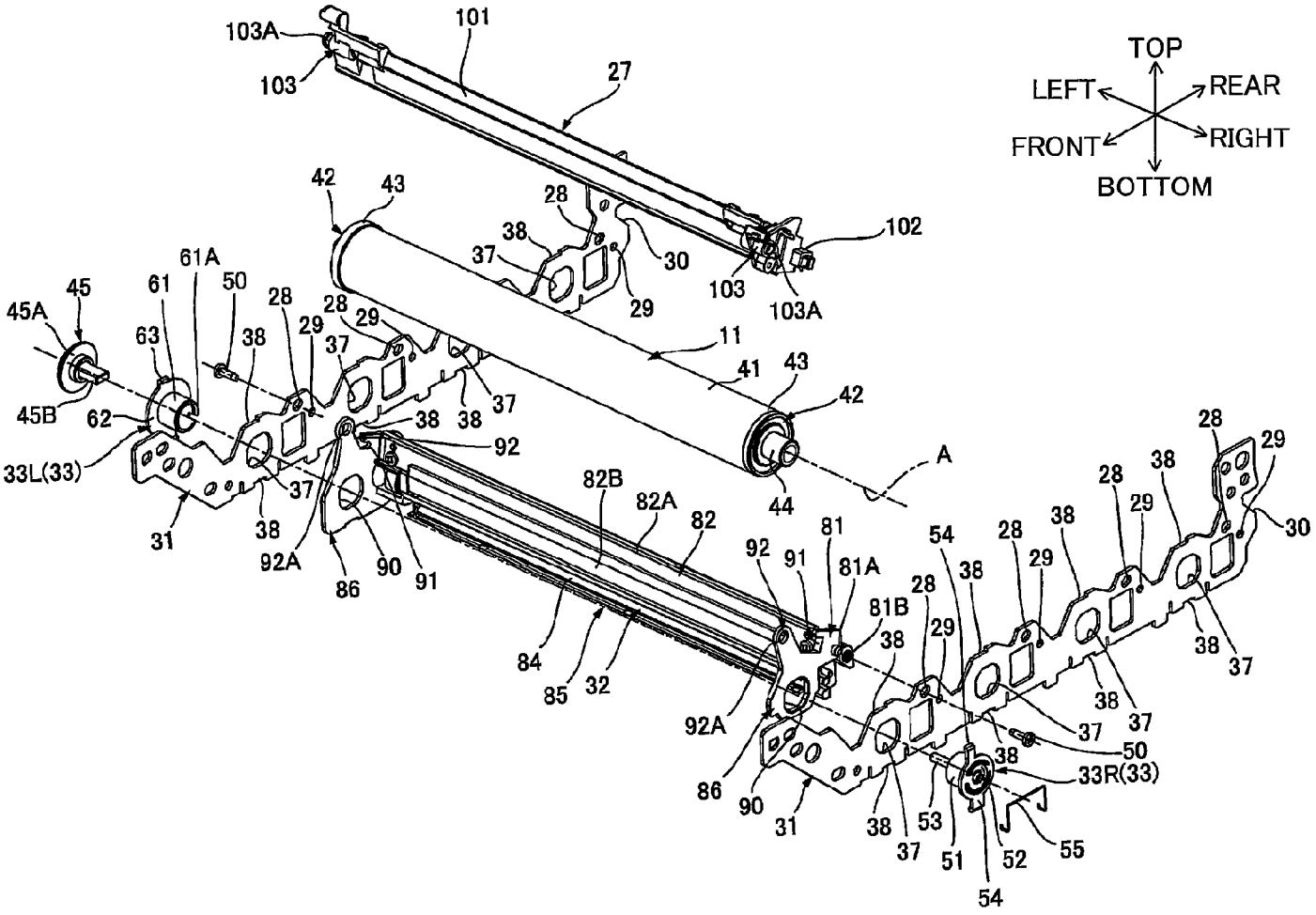
FIG. 5 is an exploded perspective view of the drum unit in FIG. 3 as viewed from an upper front right side thereof.

As illustrated in FIGS. 3 and 5, the pair of inner side plates 31 is disposed so as to be spaced apart from each other in the left-right direction. Each of the pair of inner side plates 31 has a general flat plate shape that is rectangular in a side view and elongated in the front-rear direction. Each of the pair of inner side plates 31 are formed by a pressing process on a metal plate using the same pressing mold, and accordingly has the same shape. That is, the pair of inner side plates 31 has electrical conductive properties. Each of the inner side plates 31 and the pair of inner side plates 31 are an example of a side plate. One of the pair of inner side plates 31 is an example of a first side plate; and the other of the pair of inner side plates 31 is an example of a second side plate. Each of the pair of inner side plates 31 includes a plurality of through-holes 37, a plurality of engagement portions 38, a plurality of boss insertion holes 28, a plurality of screw insertion holes 29, and a notch portion 30.

Figure 6:
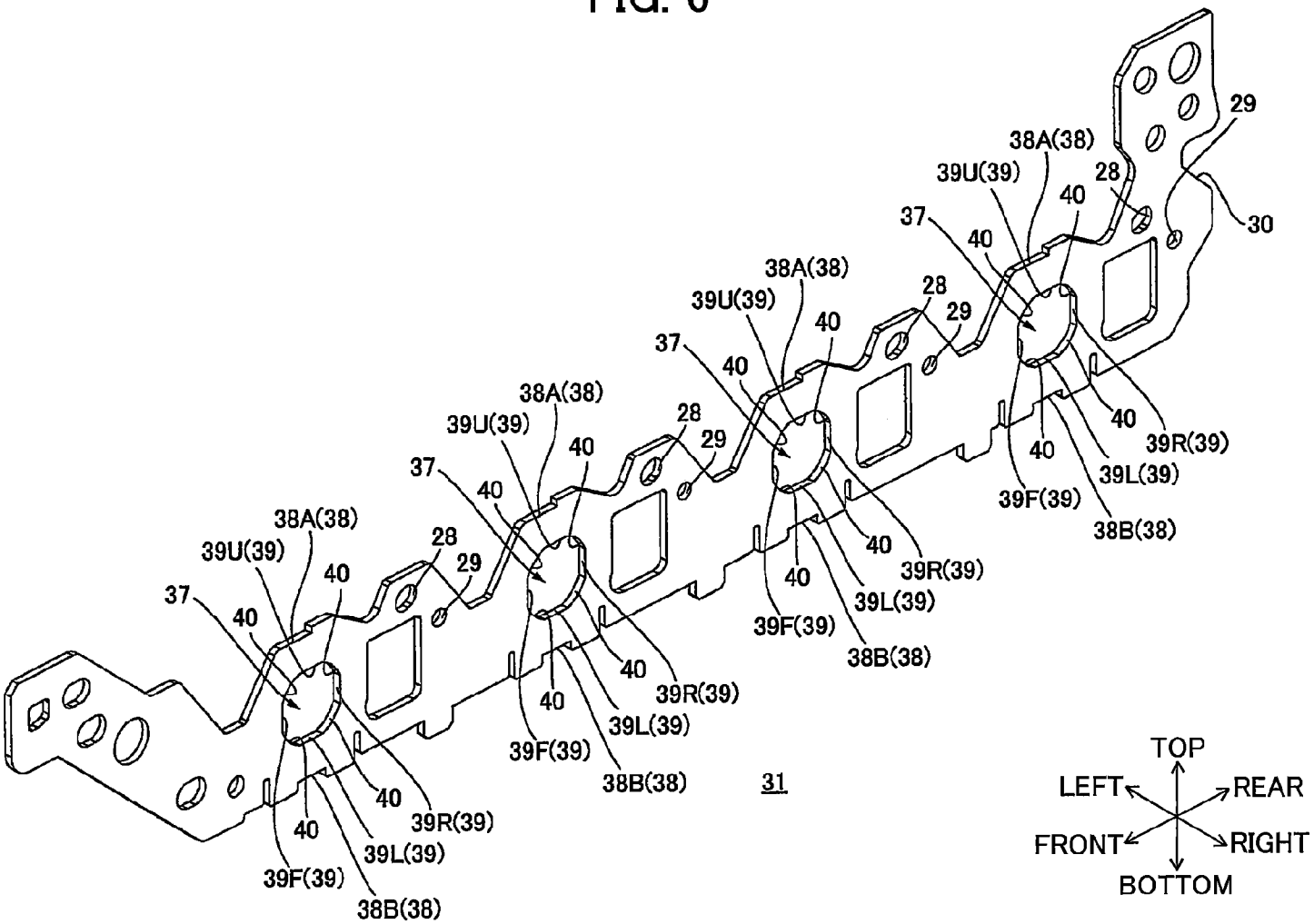
FIG. 6 is a perspective view of an inner side plate provided in the drum unit in FIG. 5 as viewed from an upper front right side thereof.

As illustrated in FIG. 6, the plurality of through-holes 37 are disposed at the same interval so as to be spaced apart from each other in the front-rear direction. The plurality of through-holes 37 are provided so as to respectively correspond to the plurality of photosensitive drums 11. Specifically, four through-holes 37 are formed in each of the pair of inner side plates 31. Each of the plurality of through-holes 37 has a general circular shape in a side view. An inner peripheral surface of each of the plurality of through-holes 37 includes a plurality of flat surfaces 39 and a plurality of curved surfaces 40.

The plurality of flat surfaces 39 respectively constitutes a front edge, a rear edge, an upper edge, and a lower edge defining the through-hole 37. The flat surface 39 constituting the front edge of the through-hole 37 will be referred to as a front flat surface 39F, the flat surface 39 constituting the rear edge of the through-hole 37 will be referred to as a rear flat surface 39R, the flat surface 39 constituting the upper edge of the through-hole 37 will be referred to as an upper flat surface 39U, and the flat surface 39 constituting the lower edge of the through-hole 37 will be referred to as a lower flat surface 39L when it is necessary to distinguish among the four. Each of the front flat surface 39F and the rear flat surface 39R extends in a vertical direction. Each of the upper flat surface 39U and the lower flat surface 39L extends in the front-rear direction.

The plurality of curved surfaces 40 respectively constitutes an upper-front edge, a lower-front edge, an upper-rear edge, and a lower-rear edge defining the through-hole 37. The upper-front curved surface 40 has a general circular-arc shape in a side view with the convex side of the arc protruding forward and upward, and connects the upper flat surface 39U to the front flat surface 39F. The lower-front curved surface 40 has a general circular-arc shape in a side view with the convex side of the arc protruding forward and downward, and connects the lower flat surface 39L to the front flat surface 39F. The upper-rear curved surface 40 has a general circular-arc shape in a side view with the convex side of the arc protruding rearward and upward, and connects the upper flat surface 39U to the rear flat surface 39R. The lower-rear curved surface 40 has a general circular-arc shape in a side view with the convex side of the arc protruding rearward and downward, and connects the lower flat surface 39L to the rear flat surface 39R.

Each of the plurality of engagement portions 38 includes an upper engagement portion 38A and a lower engagement portion 38B.

The plurality of upper engagement portions 38A are respectively disposed above the plurality of through-holes 37. Each of the plurality of upper engagement portions 38A is notched downward from an upper edge of the inner side plate 31. Each of the plurality of upper engagement portions 38A has a general rectangular shape in a side view.

The plurality of lower engagement portions 38B are respectively disposed below the plurality of through-holes 37. Each of the plurality of lower engagement portions 38B is notched upward from a lower edge of the inner side plate 31.

Each of the plurality of lower engagement portions 38B has a general rectangular shape in the side view.

The plurality of boss insertion holes 28 are respectively disposed diagonally above and rearward of the plurality of through-holes 37. Each of the plurality of boss insertion holes 28 penetrates the inner side plate 31 in the left-right direction and has a general ellipse shape in a side view that is elongated in the front-rear direction.

The plurality of screw insertion holes 29 are respectively disposed diagonally below and rearward of the plurality of boss insertion holes 28. Each of the plurality of boss insertion holes 28 penetrates the inner side plate 31 in the left-right direction and has a general circular shape in a side view.

The notch portion 30 is disposed at a rear end of the inner side plate 31. The notch portion 30 is notched forward from a rear edge of the inner side plate 31. The notch portion 30 has a general V-shape in a side view with the opening of "V" facing rearward. The notch portion 30 is an example of a contact portion.

(2) Drum Cleaner

Figure 9:
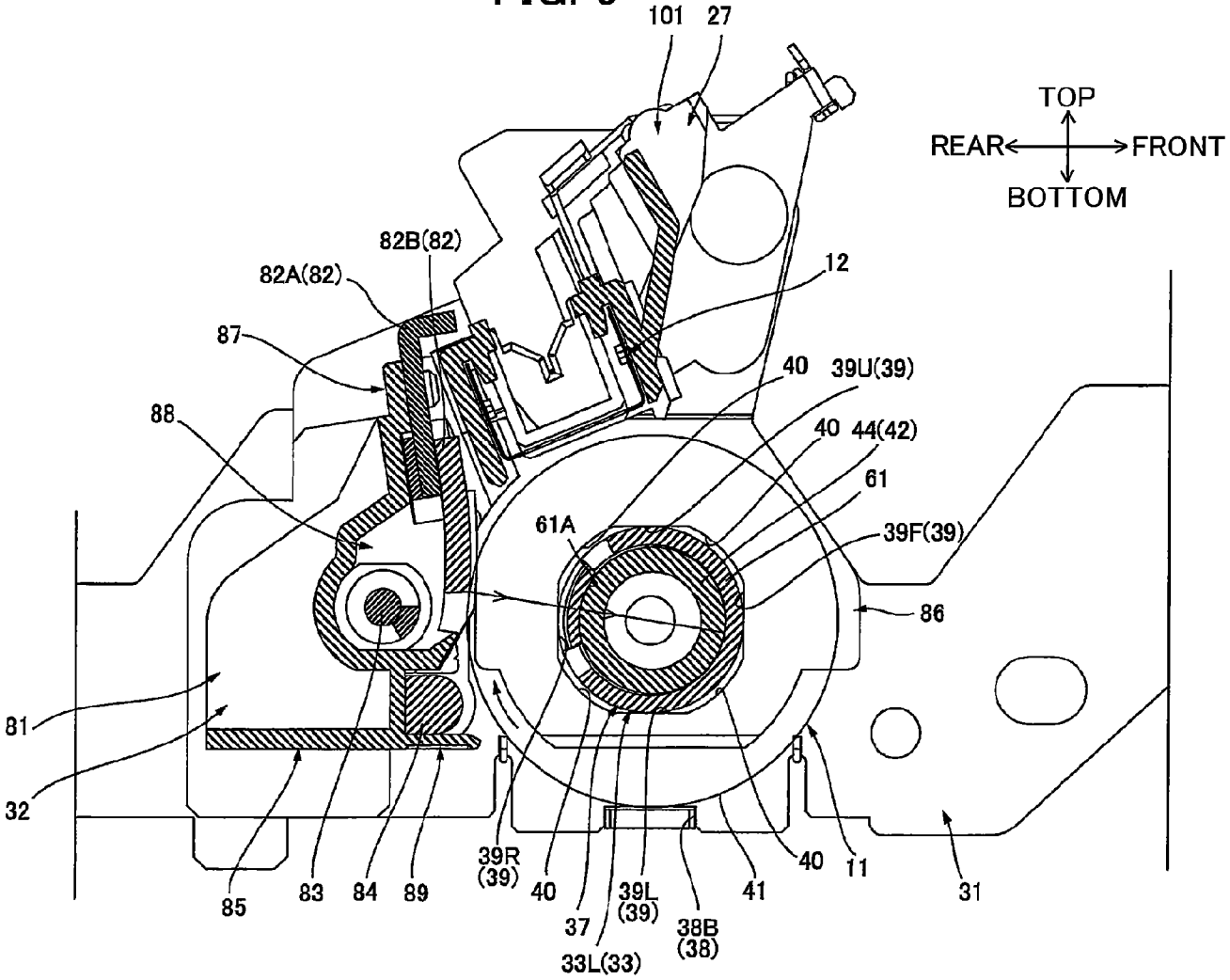
FIG. 9 is a cross-sectional view of the drum unit in FIG. 4 taken along a line A-A in FIG. 4.

As illustrated in FIGS. 5 and 9, the plurality of drum cleaners 32 respectively correspond to the plurality of photosensitive drums 11, and each of the plurality of drum cleaners 32 is disposed rearward of the corresponding photosensitive drum 11 between the pair of inner side plates 31. Each of the plurality of drum cleaners 32 includes a cleaner frame 81, a cleaning blade 82, a screw 83, and a neutralizing member 84.

Figure 7A:
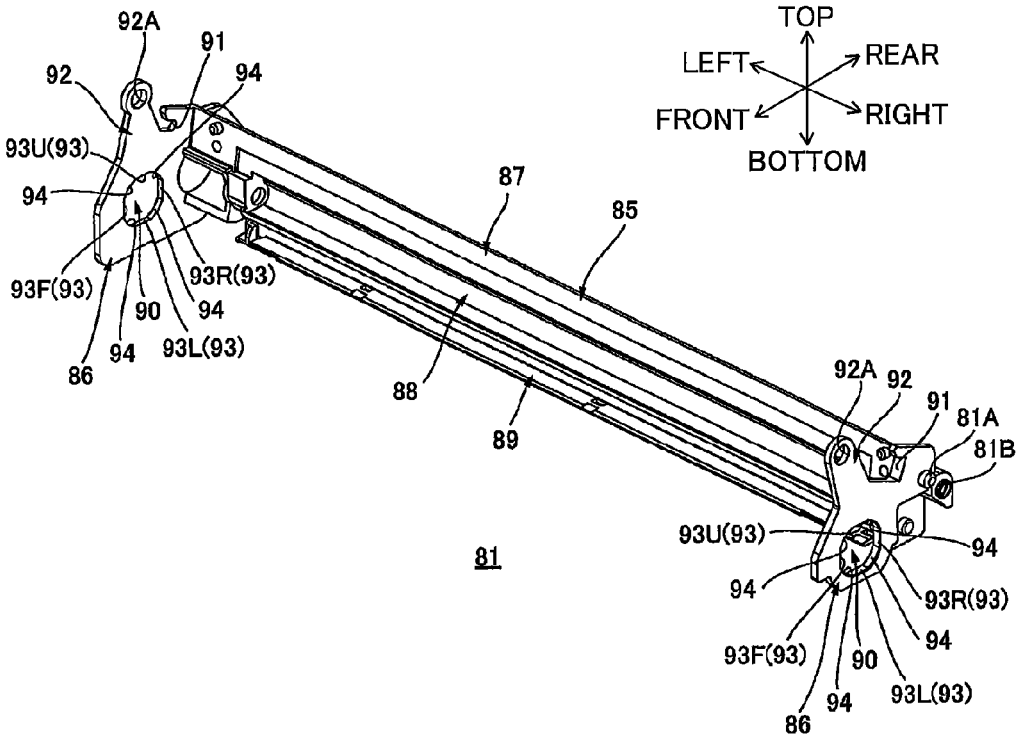
FIG. 7A is a perspective view of a cleaner frame provided in the drum unit in FIG. 5 as viewed from an upper front right side thereof.

The cleaner frame 81 is formed of an electrical insulation resin. The cleaner frame 81 includes a main body 85, a pair of wall portions 86, a pair of bosses 81A, and a pair of screw holes 81B as illustrated in FIG. 7A. The cleaner frame 81 is an example of a frame.

As illustrated in FIGS. 7A and 9, the main body 85 constitutes a rear end portion of the cleaner frame 81. The main body 85 has a general rectangular columnar shape that extends in the left-right direction and of which both left and right ends are closed. The main body 85 includes a blade support portion 87, a waste toner container 88, and a neutralizing-member support portion 89.

The blade support portion 87 constitutes an upper end portion of the main body 85. The blade support portion 87 has a general plate shape that extends in the left-right direction.

The waste toner container 88 is disposed below the blade support portion 87. The waste toner container 88 extends in the left-right direction and has a general semi-cylindrical shape of which a front end is opened. An upper end of the waste toner container 88 is continuous to a lower end of the blade support portion 87.

The neutralizing-member support portion 89 is disposed below the waste toner container 88. The neutralizing-member support portion 89 extends in the left-right direction and has a general rectangular columnar shape of which a front end is opened. An upper end of the neutralizing-member support portion 89 is continuous to a lower end of the waste toner container 88.

The pair of wall portions 86 respectively constitutes left and right end portions of the cleaner frame 81. The pair of wall portions 86 has a general plate shape that extends forward from left and right ends of the main body 85. The pair of wall portions 86 respectively contacts inner left-right surfaces of the pair of inner side plates 31 (see FIG. 10). Each of the pair of wall portions 86 includes an insertion hole 90, a charging-unit support portion 92, and an engagement groove 91.

The insertion hole 90 is formed at a substantial center region of the wall portion 86. The insertion hole 90 has a general circular shape in a side view. The insertion hole 90 is aligned with the through-hole 37 of the inner side plate 31 when projected in the left-right direction. An inner peripheral surface of the insertion hole 90 includes a plurality of flat surfaces 93 and a plurality of curved surfaces 94.

The plurality of flat surfaces 93 respectively constitutes a front edge, a rear edge, an upper edge, and a lower edge defining the insertion hole 90. The flat surface 93 constituting the front edge of the insertion hole 90 will be referred to as a front flat surface 93F, the flat surface 93 constituting the rear edge of the insertion hole 90 will be referred to as a rear flat surface 93R, the flat surface 93 constituting the upper edge of the insertion hole 90 will be referred to as an upper flat surface 93U, and the flat surface 93 constituting the lower edge of the insertion hole 90 will be referred to as a lower flat surface 93L when it is necessary to distinguish among the four. Each of the front flat surface 93F and the rear flat surface 93R extends in the vertical direction. Each of the upper flat surface 93U and the lower flat surface 93L extends in the front-rear direction.

The plurality of curved surfaces 94 respectively constitutes an upper-front edge, a lower-front edge, an upper-rear edge, and a lower-rear edge of the insertion hole 90. The upper-front curved surface 94 has a general circular-arc shape in a side view with the convex side of the arc protruding forward and upward, and connects the upper flat surface 93U to the front flat surface 93F. The lower-front curved surface 94 has a general circular-arc shape in a side view with the convex side of the arc protruding forward and downward, and connects the lower flat surface 93L to the front flat surface 93F. The upper-rear curved surface 94 has a general circular-arc shape in a side view with the convex side of the arc protruding rearward and upward, and connects the upper flat surface 93U to the rear flat surface 93R. The lower-rear curved surface 94 has a general circular-arc shape in a side view with the convex side of the arc protruding rearward and downward, and connects the lower flat surface 93L to the rear flat surface 93R.

The charging-unit support portion 92 constitutes an upper end portion of the wall portion 86. The charging-unit support portion 92 of the left wall portion 86 has a general plate shape that extends in the vertical direction. The charging-unit support portion 92 of the right wall portion 86 has a general plate shape that extends in a direction from the upper-front side toward the lower-rear side. An upper end of the charging-unit support portion 92 of the right wall portion 86 is disposed further forward than an upper end of the charging-unit support portion 92 of the left wall portion 86. The charging-unit support portion 92 is exposed on the outside of the inner side plate 31 when projected in the left-right direction. The charging-unit support portion 92 includes a fitting hole 92A.

The fitting hole 92A is formed at an upper end region of the charging-unit support portion 92. The fitting hole 92A penetrates the charging-unit support portion 92 in the left-right direction and has a general circular shape in a side view.

The engagement groove 91 is disposed rearward of the charging-unit support portion 92. The engagement groove 91 has a general L-shape in a side view. The engagement groove 91 is notched downward from an upper edge of the wall portion 86, and is further notched rearward at a lower end thereof. A groove width of the left engagement groove 91 is substantially equal to an outer diameter of a left engagement boss 102 (described later) of the charging unit 27. A groove width of the right engagement groove 91 is larger than that of the left engagement groove 91, and is substantially equal to an outer size of the right engagement boss 102 (described later) of the charging unit 27.

As illustrated in FIGS. 3 and 7A, the pair of bosses 81A is respectively provided at left and right ends of the cleaner frame 81. The pair of bosses 81A has a general columnar shape that protrudes outward in the left-right direction from the outer left-right surfaces of the main body 85. Each of the pair of bosses 81A is fitted into the boss insertion hole 28 of the corresponding inner side plate 31.

The pair of screw holes 81B is respectively disposed diagonally below and rearward of the pair of bosses 81A. The pair of screw holes 81B is recessed inward in the left-right direction from the outer left-right surfaces of the main body 85, and has a general circular shape in a side view. Each of the pair of screw holes 81B faces an inner left-right side of the screw insertion hole 29 of the corresponding inner side plate 31. The cleaner frame 81 is fixed to the pair of inner side plates 31 such that screws 50 (see FIG. 5) are threaded into the screw holes 81B through the screw insertion holes 29 of the inner side plates 31.

As illustrated in FIGS. 5 and 9, the cleaning blade 82 includes a support member 82A and a blade body 82B.

The support member 82A is formed of metal, and has a general plate shape that extends in the left-right direction. The support member 82A is fixed to the blade support portion 87 of the cleaner frame 81. The support member 82A has electrical conductive properties. The support member 82A is an example of a support member, and a conducting member. Further, one of the plurality of support members 82A is an example of a first support member, and another of the plurality of support members 82A is an example of a second support member.

The blade body 82B is formed of an elastic member such as rubber, and has a general plate shape that extends in the left-right direction. An upper end of the blade body 82B is fixed to the support member 82A. A lower end of the blade body 82B faces a front side of the waste toner container 88 so as to cover an upper half of the waste toner container 88. Further, the lower end of the blade body 82B elastically contacts a rear surface of a drum body 41 (described later) of the photosensitive drum 11 while being curved rearward. Accordingly, the blade body 82B presses the photosensitive drum 11 diagonally forward and downward. The blade body 82B is an example of a cleaning member. Further, one of the plurality of blade bodies 82B is an example of a first cleaning member, and another of the plurality of blade bodies 82B is an example of a second cleaning member.

As illustrated in FIG. 9, the screw 83 is disposed inside the waste toner container 88. The screw 83 is an auger screw that extends in the left-right direction.

The neutralizing member 84 is fixed into the neutralizing-member support portion 89. The neutralizing member 84 has a semi-columnar shape that extends in the left-right direction. A front surface of the neutralizing member 84 has a general circular-arc shape in a side view such that its vertical center portion protrudes forward. The neutralizing member 84 reduces the charge potential of the surface of the photosensitive drum 11 by exposing the surface of the photosensitive drum 11 after the toner image has been transferred onto the sheet P.

(3) Charging Unit

Figure 4:
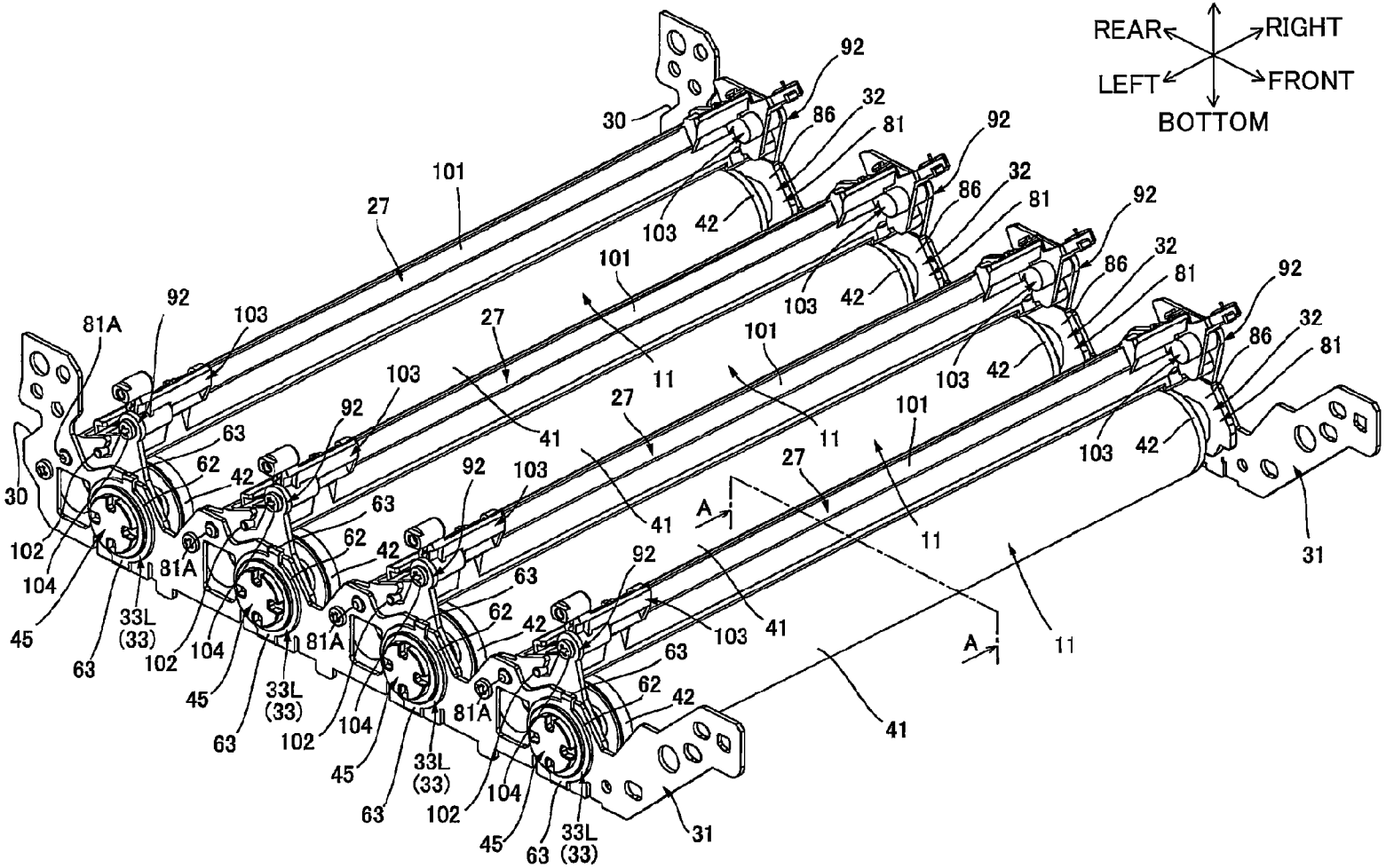
FIG. 4 is a perspective view of the drum unit in FIG. 3 as viewed from an upper front left side thereof.
Figure 7B:
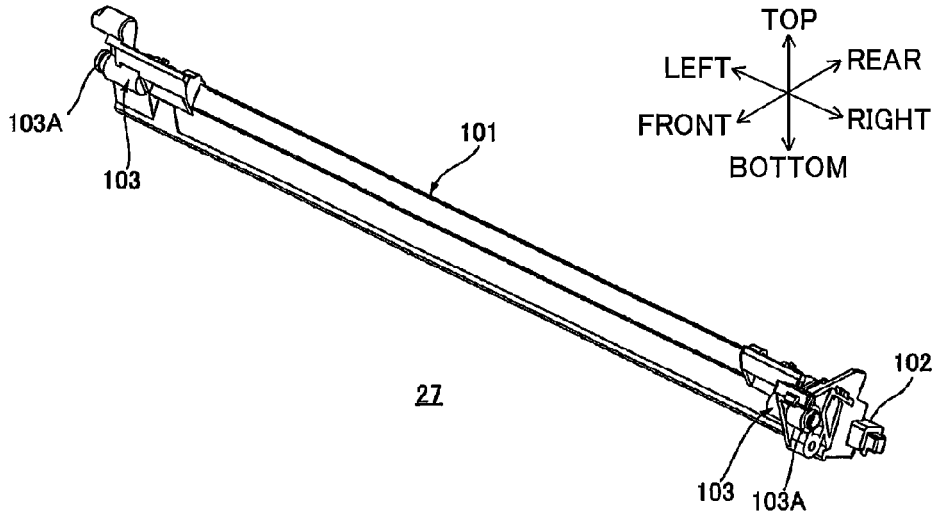
FIG. 7B is a perspective view of a charging unit provided in the drum unit in FIG. 5 as viewed from an upper front right side thereof.

As illustrated in FIGS. 4 and 7B, each of the plurality of charging units 27 is disposed between the pair of charging-unit support portions 92 of the cleaner frame 81. Each of the plurality of charging units 27 includes the scorotron charger 12 and a charger frame 101 that supports the scorotron charger 12.

The charger frame 101 extends in the left-right direction, and has a general rectangular columnar shape of which left and right ends are closed. The charger frame 101 includes the pair of engagement bosses 102 and a pair of arm portions 103.

The pair of engagement bosses 102 is respectively provided at left and right ends of the charger frame 101 on rear ends thereof. The left engagement boss 102 has a general columnar shape that protrudes leftward from a left wall of the charger frame 101, and is fitted into the left engagement groove 91 of the cleaner frame 81. The right engagement boss 102 has a general rectangular columnar shape that protrudes rightward from a right wall of the charger frame 101, and is fitted into the right engagement groove 91 of the cleaner frame 81. With this configuration, the rear end of the charger frame 101 is supported by the cleaner frame 81 while the movement thereof in the vertical direction is regulated.

The pair of arm portions 103 is respectively provided at the left and right ends of the charger frame 101 on front ends thereof. The left arm portion 103 has a general columnar shape that extends in the vertical direction. The right arm portion 103 has a general plate shape that extends in the direction from the upper-front side toward the lower-rear side. An upper end of the right arm portion 103 is disposed further forward than an upper end of the left arm portion 103. Each of the pair of arm portions 103 includes a fitting boss 103A.

Figure 10:
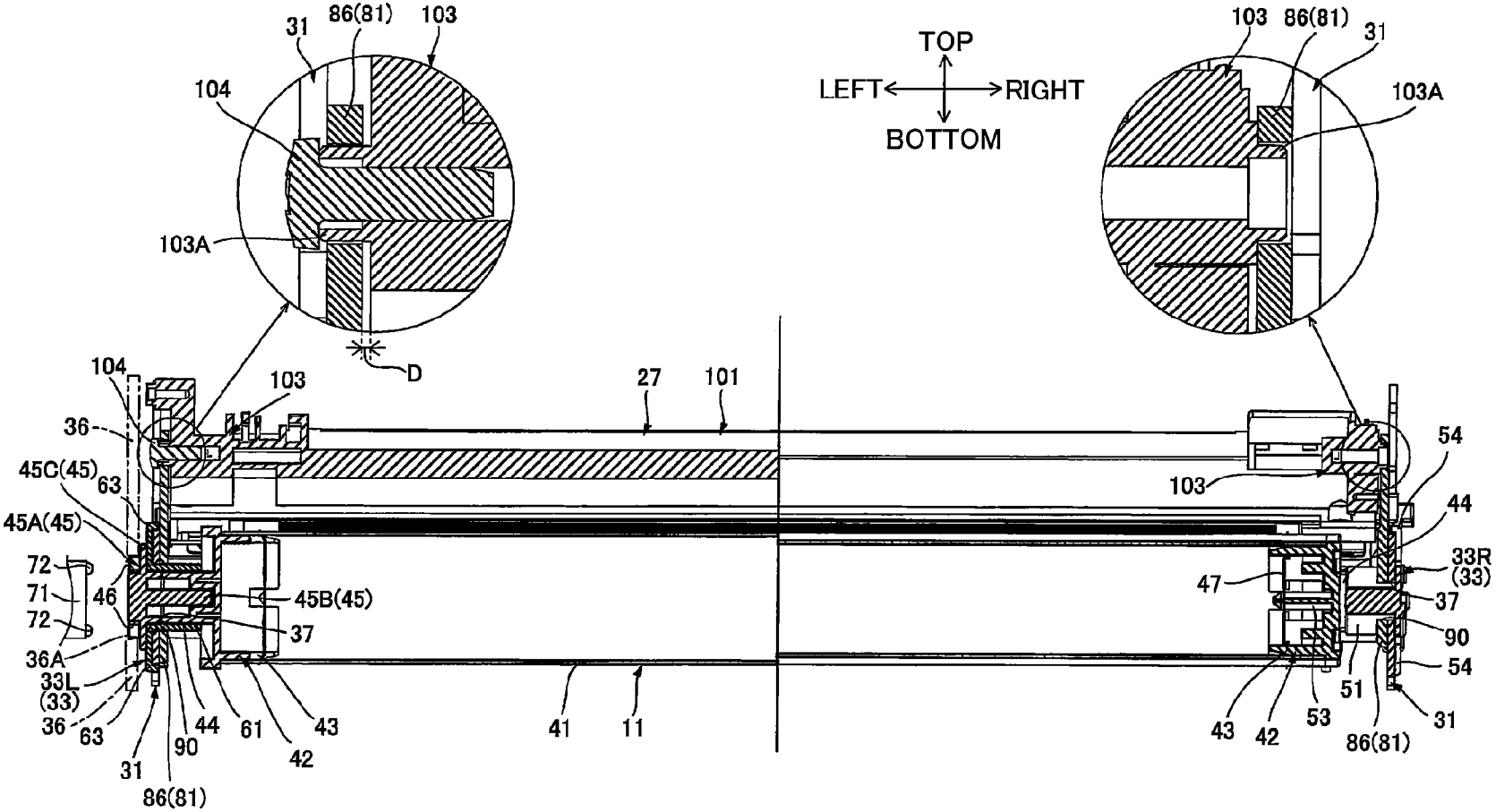
FIG. 10 is a cross-sectional view of the drum unit in FIG. 3 taken along a line B-B in FIG. 3.

As illustrated in FIG. 10, the fitting boss 103A protrudes outward in the left-right direction from an outer left-right surface of the arm portion 103, and has a general cylindrical shape. The left fitting boss 103A is fitted into the fitting hole 92A of the left charging-unit support portion 92 of the cleaner frame 81. The right fitting boss 103A is fitted into the fitting hole 92A of the right charging-unit support portion 92 of the cleaner frame 81. With this configuration, the front end of the charger frame 101 is supported by the cleaner frame 81 while the movement thereof in a radial direction of the fitting bosses 103A is regulated.

Further, a left-right dimension of the left fitting boss 103A is slightly larger than a left-right dimension of the charging-unit support portion 92 of the cleaner frame 81. A left-right dimension of the right fitting boss 103A is slightly smaller than the left-right dimension of the charging-unit support portion 92 of the cleaner frame 81. A left-right distance between a right edge (an inner left-right edge) of the left fitting boss 103A and a left edge (an inner left-right edge) of the right fitting boss 103A is slightly smaller than a left-right distance between a right surface (an inner left-right surface) of the left charging-unit support portion 92 and a left surface (an inner left-right surface) of the right charging-unit support portion 92. That is, as illustrated in FIG. 10, the charging unit 27 is supported between the pair of charging-unit support portions 92 of the cleaner frame 81 with a slight gap D in the left-right direction.

(4) Photosensitive Drum

As illustrated in FIGS. 5 and 10, each of the plurality of photosensitive drums 11 includes the drum body 41 and a pair of flange members 42.

The drum body 41 is disposed between the pair of inner side plates 31. The drum body 41 is a metal tube having a general cylindrical shape that extends in the left-right direction, and a photosensitive layer is formed on its outer circumferential surface. A left end of the drum body 41 is disposed spaced apart from the inner left-right surface of the left inner side plate 31, and a right end of the drum body 41 is disposed spaced apart from the inner left-right surface of the right inner side plate 31.

The pair of flange members 42 is respectively fitted with the left and right ends of the drum body 41 so as to be incapable of rotating relative to the drum body 41. Each of the pair of flange members 42 includes a large diameter portion 43 and a small diameter portion 44. The left flange member 42 further includes a drum coupling 45. The right flange member 42 further includes a grounding plate 47.

The large diameter portion 43 constitutes an inner left-right end portion of the flange member 42. The large diameter portion 43 has a general cylindrical shape of which an outer left-right end is closed. An outer diameter of the large diameter portion 43 is substantially equal to an inner diameter of the drum body 41. The large diameter portion 43 is inserted into the drum body 41.

The small diameter portion 44 protrudes outward in the left-right direction from an outer left-right wall of the large diameter portion 43. The small diameter portion 44 has a general cylindrical shape that is coaxial with the large diameter portion 43. An outer diameter of the small diameter portion 44 is smaller than the outer diameter of the large diameter portion 43.

Figure 8:
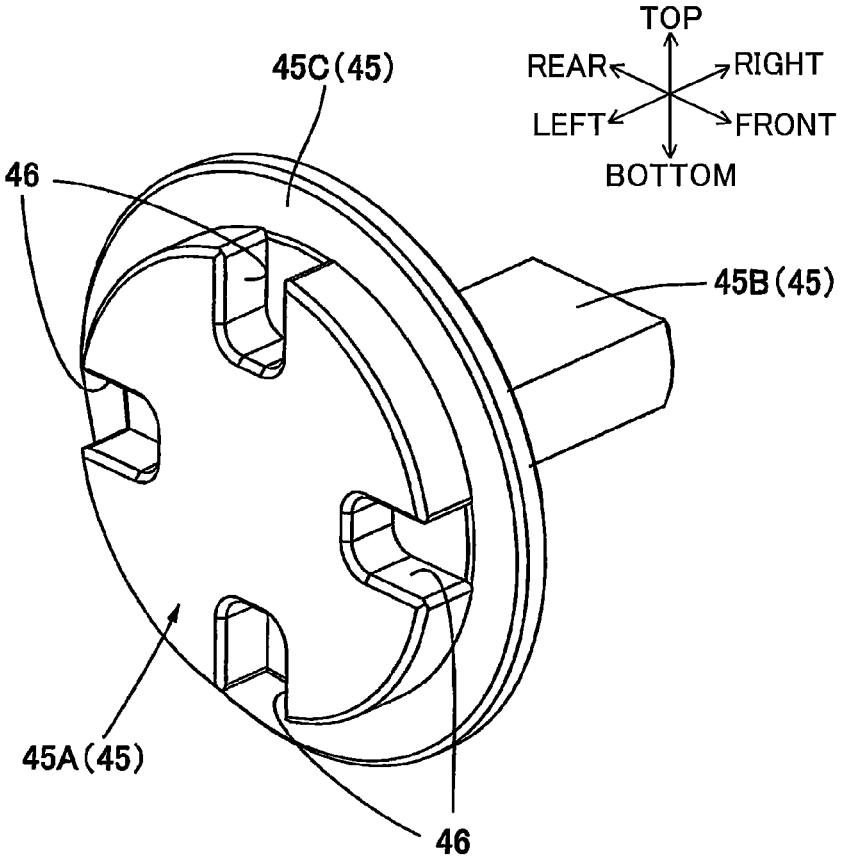
FIG. 8 is a perspective view of a drum coupling provided in the drum unit in FIG. 5 as viewed from an upper front left side thereof.

As illustrated in FIGS. 8 and 10, the drum coupling 45 constitutes a left end portion of the left flange member 42. The drum coupling 45 includes a driving receiving portion 45A, a fitting portion 45B, and a flange 45C.

The driving receiving portion 45A constitutes a left end portion of the drum coupling 45 and disposed leftward (outward in the left-right direction) of the left inner side plate 31. The driving receiving portion 45A has a general disk shape. The driving receiving portion 45A includes a plurality of engagement concave portions 46.

The plurality of engagement concave portions 46 is formed at a peripheral edge of the driving receiving portion 45A with a gap therebetween in a circumferential direction of the driving receiving portion 45A. Specifically, four engagement concave portions 46 are provided in the drum coupling 45. Each of the plurality of engagement concave portions 46 is recessed rightward from a left surface of the drum coupling 45. Each of the plurality of engagement concave portions 46 has a general rectangular shape in a side view. Each of the plurality of engagement concave portions 46 receives an engagement protrusion 72 of a main coupling 71 provided in the main casing 2.

The fitting portion 45B has a general rectangular columnar shape that extends rightward from a right surface of the driving receiving portion 45A. The fitting portion 45B is detachably fitted with the small diameter portion 44 of the left flange member 42 so as to be incapable of rotating relative to the small diameter portion 44.

The flange 45C protrudes radially outward from an outer peripheral surface of a right end portion of the driving receiving portion 45A, and extends in the circumferential direction of the driving receiving portion 45A. The flange 45C has a general annular shape. The flange 45C is disposed between the left inner side plate 31 and a peripheral edge defining a through-hole 36A (described later) formed in the left outer side plate 36. This configuration restricts the drum coupling 45 from being detached leftward from the small diameter portion 44 of the left flange member 42.

The grounding plate 47 is provided at a left end portion of the right flange member 42. The grounding plate 47 has a general disk shape, and is electrically connected to the inner circumferential surface of the drum body 41.

(5) Bearing Member

The plurality of bearing members 33 include a plurality of left bearing members 33L and a plurality of right bearing members 33R.

(5-1) Left Bearing Member

As illustrated in FIGS. 4, 5 and 10, the plurality of left bearing members 33L is provided at a left side of the left inner side plate 31 so as to respectively correspond to the plurality of photosensitive drums 11. Specifically, four left bearing members 33L are provided in the drum unit 9. Each of the plurality of left bearing members 33L includes a cylindrical portion 61 and a flange portion 62.

The cylindrical portion 61 has a general cylindrical shape that extends in the left-right direction. Both left and right ends of the cylindrical portion 61 are opened. An inner diameter of the cylindrical portion 61 is substantially equal to the outer diameter of the small diameter portion 44 of the flange member 42. An outer diameter of the cylindrical portion 61 is substantially equal to a diameter of an inscribed circle that is inscribed in the plurality of flat surfaces 39 of the through-hole 37 formed in the inner side plate 31. The cylindrical portion 61 is fitted with the small diameter portion 44 of the left flange member 42 from radially outside thereof and capable of rotating relative to the left flange member 42. Further, the cylindrical portion 61 is fitted in the through-hole 37 formed in the left inner side plate 31 and the insertion hole 90 formed in the left wall portion 86 of the cleaner frame 81. A front peripheral surface of the cylindrical portion 61 contacts the front flat surface 39F of the through-hole 37 formed in the left inner side plate 31 and the front flat surface 93F of the insertion hole 90 formed in the left wall portion 86. A rear peripheral surface of the cylindrical portion 61 contacts the rear flat surface 39R of the through-hole 37 formed in the left inner side plate 31 and the rear flat surface 93R of the insertion hole 90 formed in the left wall portion 86. An upper peripheral surface of the cylindrical portion 61 contacts the upper flat surface 39U of the through-hole 37 formed in the left inner side plate 31 and the upper flat surface 93U of the insertion hole 90 formed in the left wall portion 86. A lower peripheral surface of the cylindrical portion 61 contacts the lower flat surface 39L of the through-hole 37 formed in the left inner side plate 31 and the lower flat surface 93L of the insertion hole 90 formed in the left wall portion 86. The cylindrical portion 61 includes a pressing rib 61A.

The pressing rib 61A is provided at an inner peripheral surface of a right end (an inner left-right end) of the cylindrical portion 61 on its upper-rear side. The pressing rib 61A protrudes radially inward from the inner peripheral surface of the cylindrical portion 61, and extends in a circumferential direction of the cylindrical portion 61. The pressing rib 61A contacts an upper-rear end portion of the small diameter portion 44 of the left flange member 42 so as to press the small diameter portion 44 of the left flange member 42 diagonally forward and downward. The direction in which the pressing rib 61A presses the small diameter portion 44 of the left flange member 42 is substantially coincident with the direction in which the blade body 82B presses the drum body 41.

The flange portion 62 protrudes radially outward from an outer peripheral surface of the left end of the cylindrical portion 61, and extends in the circumferential direction of the cylindrical portion 61. The flange portion 62 has a general annular shape. The flange portion 62 includes a pair of engagement portions 63.

Each of the pair of engagement portions 63 is provided at an upper end and a lower end of the flange portion 62. The upper engagement portion 63 protrudes upward from an upper edge of an annular portion of the flange portion 62, and is bent rightward. The lower engagement portion 63 protrudes downward from a lower edge of the annular portion of the flange portion 62, and is bent rightward. The upper and lower engagement portions 63 respectively engage with the upper and lower engagement portions 38A, 38B of the left inner side plate 31.

(5-2) Right Bearing Member

As illustrated in FIGS. 3 and 10, the plurality of right bearing members 33R is provided at a right side of the right inner side plate 31 so as to respectively correspond to the plurality of photosensitive drums 11. Specifically, four right bearing members 33R are provided in the drum unit 9. Each of the plurality of right bearing members 33R includes a cylindrical portion 51, a flange portion 52, and a shaft 53.

The cylindrical portion 51 has a general cylindrical shape that extends in the left-right direction. A left end of the cylindrical portion 51 is opened while a right end of the cylindrical portion 51 is closed. An inner diameter of the cylindrical portion 51 is substantially equal to the outer diameter of the small diameter portion 44 of the flange member 42. An outer diameter of the cylindrical portion 51 is substantially equal to the diameter of the inscribed circle that is inscribed in the plurality of flat surfaces 39 of the through-hole 37 formed in the inner side plate 31. The cylindrical portion 51 is fitted with the small diameter portion 44 of the right flange member 42 from radially outside thereof and capable of rotating relative to the right flange member 42. Further, the cylindrical portion 51 is fitted in the through-hole 37 formed in the right inner side plate 31 and the insertion hole 90 formed in the right wall portion 86 of the cleaner frame 81. A front peripheral surface of the cylindrical portion 51 contacts the front flat surface 39F of the through-hole 37 formed in the right inner side plate 31 and the front flat surface 93F of the insertion hole 90 formed in the right wall portion 86. A rear peripheral surface of the cylindrical portion 51 contacts the rear flat surface 39R of the through-hole 37 formed in the right inner side plate 31 and the rear flat surface 93R of the insertion hole 90 formed in the right wall portion 86. An upper peripheral surface of the cylindrical portion 51 contacts the upper flat surface 39U of the through-hole 37 formed in the right inner side plate 31 and the upper flat surface 93U of the insertion hole 90 formed in the right wall portion 86. A lower peripheral surface of the cylindrical portion 51 contacts the lower flat surface 39L of the through-hole 37 formed in the right inner side plate 31 and the lower flat surface 93L of the insertion hole 90 formed in the right wall portion 86. The cylindrical portion 51 includes a pressing rib 51A.

The pressing rib 51A is provided at an inner peripheral surface of a left end (an inner left-right end) of the cylindrical portion 51 on its upper-rear side. The pressing rib 51A protrudes radially inward from the inner peripheral surface of the cylindrical portion 51, and extends in a circumferential direction of the cylindrical portion 51. The pressing rib 51A contacts an upper-rear end portion of the small diameter portion 44 of the right flange member 42 so as to press the small diameter portion 44 of the right flange member 42 diagonally forward and downward. The direction in which the pressing rib 51A presses the small diameter portion 44 of the right flange member 42 is coincident with the direction in which the pressing rib 61A presses the small diameter portion 44 of the left flange member 42 and is substantially coincident with the direction in which the blade body 82B presses the drum body 41.

The flange portion 52 protrudes radially outward from an outer peripheral surface of the right end of the cylindrical portion 51, and extends in the circumferential direction of the cylindrical portion 51. The flange portion 52 has a general annular shape. The flange portion 52 includes a pair of engagement portions 54.

Each of the pair of engagement portions 54 is provided at an upper end and a lower end of the flange portion 52. The upper engagement portion 54 protrudes upward from an upper edge of an annular portion of the flange portion 52, and is bent leftward. The lower engagement portion 54 protrudes downward from a lower edge of the annular portion of the flange portion 52, and is bent leftward. The upper and lower engagement portions 54 respectively engage with the upper and lower engagement portions 38A, 38B of the right inner side plate 31.

The shaft 53 is provided at a radially center region of the cylindrical portion 51. The shaft 53 is formed of metal, and has a general columnar shape that extends in the left-right direction. The shaft 53 is fixed to a radially center region of a right wall of the cylindrical portion 51 so as to penetrate the right wall of the cylindrical portion 51 in the left-right direction. The shaft 53 is inserted into the right flange member 42, and contacts the grounding plate 47 at its left end. A right end of the shaft 53 protrudes rightward from the right wall of the cylindrical portion 51.

(6) Front Plate, Rear Plate, and Outer Side Plate

As illustrated in FIG. 2, the front plate 34 constitutes a front end of the drum unit 9. The front plate 34 has a general rectangular flat plate shape in a front view that is elongated in the left-right direction. The front plate 34 bridges front ends of the pair of inner side plates 31.

The rear plate 35 constitutes a rear end of the drum unit 9. The rear plate 35 has a general rectangular flat plate shape in a front view that is elongated in the left-right direction. The rear plate 35 bridges rear ends of the pair of inner side plates 31.

The pair of outer side plates 36 is respectively disposed outward of the pair of inner side plates 31 in the left-right direction. Each of the pair of outer side plates 36 is formed of resin, and has a general rectangular flat plate shape in a side view having a vertical dimension larger than that of the pair of inner side plates 31. As illustrated in FIG. 10, the left outer side plate 36 has the through-hole 36A in which the driving receiving portion 45A of the drum coupling 45 is rotatably fitted. The left outer side plate 36 faces a left side of the flange 45C of the drum coupling 45 at the peripheral edge defining the through-hole 36A.

3. Configuration on Grounding of Drum Unit to Main Casing (1) Drum Grounding Member and Blade Grounding Member As illustrated in FIGS. 3 and 11, the drum unit 9 further includes a plurality of drum grounding members 55 and a plurality of blade grounding members 80.

As illustrated in FIGS. 3 and 5, the plurality of drum grounding members 55 are disposed at a right side of the right inner side plate 31 so as to respectively correspond to the plurality of photosensitive drums 11. Specifically, four drum grounding members 55 are provided in the drum unit 9. Each of the plurality of drum grounding members 55 is formed of a metallic wire, extending in the front-rear direction and bent downward from both front and rear ends thereof. A front-rear center portion of each of the plurality of drum grounding members 55 contacts the right end of the shaft 53 of the corresponding photosensitive drum 11. Lower ends of each of the plurality of drum grounding members 55 engage with the lower edge of the right inner side plate 31. Accordingly, each of the plurality of drum grounding members 55 electrically connects the corresponding photosensitive drum 11 and the right inner side plate 31.

Figure 11:
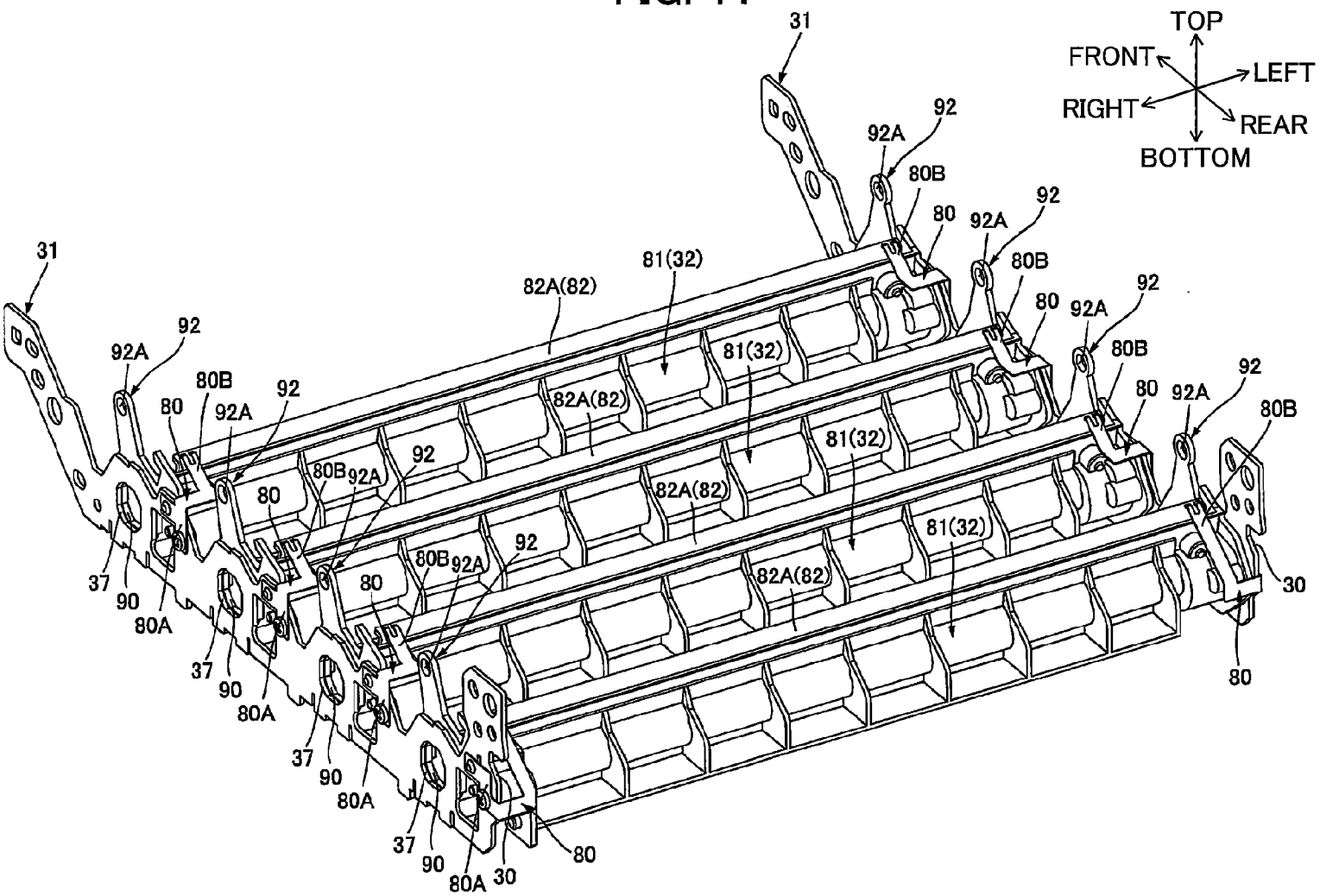
FIG. 11 is an explanatory view for explaining how cleaning blades are grounded.

As illustrated in FIG. 11, the plurality of blade grounding members 80 respectively correspond to the plurality of cleaning blades 82, and are disposed one at each left-right end of the corresponding cleaning blade 82. Specifically, eight blade grounding member 80 are provided in the drum unit 9. Thus, two blade grounding members 80 are provided at each of the plurality of cleaning blade 82. The blade grounding member 80 is an example of a connecting member. One of the four blade grounding members 80 at one of the left and right sides is an example of a first connecting member, and another of the four blade grounding members 80 at one of the left and right sides is an example of a third connecting member, and one of the four blade grounding members 80 at the other of the left and right sides is an example of a second connecting member, and another of the four blade grounding members 80 at the other of the left and right sides is an example of a fourth blade grounding members 80. Each of the plurality of blade grounding members 80 includes a fixed portion 80A and a contact portion 80B.

The fixed portion 80A constitutes an outer left-right end portion of the blade grounding member 80. The fixed portion 80A is formed of metal. The fixed portion 80A is plate-shaped and has a general L-shape in a side view. The fixed portion 80A is fixed to the inner side plate 31 by the screw 50. With this configuration, the fixed portion 80A is electrically connected to the inner side plate 31.

The contact portion 80B extends inward in the left-right direction from the fixed portion 80A, and is bent forward at its inner left-right end, and resiliently contacts an upper surface on a left-right end of the support member 82A of the cleaning blade 82 at its free end portion (front end portion). In other words, a portion of the contact portion 80B that extends inward in the left-right direction from the fixed portion 80A is an example of a first portion, and a portion of the contact portion 80B that is bent at the inner left-right end of the first portion and extends forward therefrom is an example of a second portion. The front end portion of the contact portion 80B contacting the support member 82A of the cleaning blade 82 has a biforked (bifurcated) shape. Accordingly, the contact portion 80B is electrically connected to the support member 82A of the cleaning blade 82. That is, both left and right ends of the support member 82A of the cleaning blade 82 are respectively and electrically connected to the left and right inner side plates 31 through the left and right blade grounding members 80.

(2) Reference Shaft

As illustrated in FIG. 1, the main casing 2 includes a reference shaft 70.

The reference shaft 70 is disposed inside the main casing 2 at its rear end portion. The reference shaft 70 is formed of metal, and has a general columnar shape that extends in the left-right direction. The reference shaft 70 has electrical conductive properties. The reference shaft 70 is an example of an external member.

(3) Grounding of Photosensitive Drum and Cleaning Blade to Main Casing

When the process unit 3 is mounted in the main casing 2, the notch portions 30 of the left and right inner side plates 31 respectively abut against the left and right ends of the reference shaft 70. As a result, the left and right inner side plates 31 are respectively and electrically connected to the reference shaft 70.

Then, as illustrated in FIGS. 3, 10 and 11, the drum body 41 of each of the plurality of photosensitive drums 11 is grounded to the reference shaft 70 of the main casing 2 through the grounding plate 47 of the corresponding right flange member 42, the shaft 53 of the corresponding right bearing member 33R, the corresponding drum grounding member 55, and the right inner side plate 31 in sequence. Further, the drum body 41 of each of the plurality of photosensitive drums 11 is grounded to the reference shaft 70 of the main casing 2 through the grounding plate 47 of the corresponding right flange member 42, the shaft 53 of the corresponding right bearing member 33R, the corresponding drum grounding member 55, the right inner side plate 31, the corresponding right blade grounding member 80, the corresponding support member 82A, the corresponding left blade grounding member 80, and the left inner side plate 31 in sequence.

As illustrated in FIG. 11, each of the plurality of cleaning blades 82 is grounded to the reference shaft 70 of the main casing 2 through the corresponding left blade grounding member 80 and the left inner side plate 31 in sequence. Further, each of the plurality of cleaning blades 82 is also grounded to the reference shaft 70 of the main casing 2 through the corresponding right blade grounding member 80 and the right inner side plate 31 in sequence.

4. Operation for Replacing Photosensitive Drum

An operation for replacing the photosensitive drums 11 will be described with reference to FIGS. 4 and 10.

There is a case in which any of the plurality of photosensitive drums 11 is replaced during a maintenance operation of the drum unit 9.

In order to replace a photosensitive drum 11, an operator first separates the corresponding charging unit 27 from the drum cleaner 32 while the right and left outer side plates 36 have been removed.

In order to separate the charging unit 27 from the drum cleaner 32, a screw 104 (see FIG. 10) is first removed from the left fitting boss 103A of the charging unit 27.

Subsequently, the charging unit 27 is moved leftward so as to bend the left charging-unit support portion 92, and the right fitting boss 103A is separated from the fitting hole 92A of the right charging-unit support portion 92.

Thereafter, the left fitting boss 103A is separated from the fitting hole 92A of the left charging-unit support portion 92. Accordingly, the charging unit 27 is completely separated from the drum cleaner 32.

Subsequently, in order to replace the photosensitive drum 11, the operator first sequentially removes the corresponding drum coupling 45, the corresponding drum grounding member 55, and the corresponding left and right bearing members 33, and then removes the photosensitive drum 11 from the pair of inner side plates 31.

Subsequently, in order to replace the photosensitive drum 11, the operator disposes a new photosensitive drum 11 between the pair of inner side plates 31, and then, sequentially assembles the corresponding left and right bearing members 33, the corresponding drum coupling 45, and the corresponding drum grounding member 55.

Subsequently, in order to replace the photosensitive drum 11, the operator attaches the corresponding charging unit 27 to the corresponding drum cleaner 32.

In order to attach the charging unit 27 to the drum cleaner 32, the left fitting boss 103A is first fitted into the fitting hole 92A of the corresponding left charging-unit support portion 92.

Then, the charging unit 27 is moved leftward so as to bend the left charging-unit support portion 92, and the right fitting boss 103A is fitted into the fitting hole 92A of the corresponding right charging-unit support portion 92.

Subsequently, the screw 104 is threaded into the left fitting boss 103A of the charging unit 27.

Accordingly, the charging unit 27 is completely attached to the corresponding drum cleaner 32.

Thereafter, the left and right outer side plates 36 are assembled. This completes the operation for replacing the photosensitive drum 11.

5. Operation for Cleaning Photosensitive Drum

During the image forming operation described above, there is a case in which toner (residual toner) that has not been transferred onto the sheet P may remain on the surfaces of the photosensitive drums 11 or paper dust from the sheet P may be deposited on the surfaces of the photosensitive drums 11 after the toner images are transferred onto the sheet P.

As illustrated in FIG. 9, extraneous matter such as residual toner and paper dust is scraped off from the surfaces of the photosensitive drums 11 by the corresponding cleaning blades 82 in conjunction with the rotation (see an arrow in FIG. 8) of the photosensitive drums 11, and is stored in the corresponding waste toner containers 88.

6. Operational Advantages (1) According to the drum unit 9, as illustrated in FIG. 11, each support member 82A that supports the blade body 82B can be grounded to the inner side plates 31 by the corresponding blade grounding members 80.

Hence, when the drum unit 9 is mounted in the main casing 2 and the notch portions 30 of the inner side plates 31 are brought into contact with the reference shaft 70 of the main casing 2, the support members 82A can be grounded to the main casing 2 by using the inner side plates 31.

As a result, the cleaning blades 82 can be grounded to the main casing 2 with a simple configuration.

(2) According to the drum unit 9, as illustrated in FIG. 11, the left and right inner side plates 31 can be electrically connected to each other by the left and right blade grounding members 80 through the support members 82A.

Hence, the support members 82A can be grounded to each of the left and right inner side plates 31.

As a result, the cleaning blades 82 can be grounded more reliably.

(3) According to the drum unit 9, as illustrated in FIG. 11, the inner side plates 31 and the blade grounding members 80 can be fixed to the cleaner frames 81.

As a result, the cleaning blades 82 can be grounded with a simpler configuration.

(4) According to the drum unit 9, as illustrated in FIG. 11, each blade grounding member 80 elastically contacts the support member 82A at the free end (front end) of the contact portion 80B.

Hence, the blade grounding member 80 and the support member 82A can be reliably and electrically connected with a simple configuration.

(5) According to the drum unit 9, as illustrated in FIGS. 3 and 10, the drum body 41 of each photosensitive drum 11 is electrically connected to the inner side plates 31 through the grounding plate 47, the shaft 53, and the drum grounding member 55 in sequence.

Hence, the photosensitive drums 11 can be also grounded by using the inner side plates 31.

As a result, the photosensitive drums 11 and the cleaning blades 82 can be grounded with a simple configuration.

(6) According to the drum unit 9, as illustrated in FIG. 11, the plurality of photosensitive drums 11 and the plurality of cleaning blades 82 can be grounded with a simple configuration.

(7) According to the drum unit 9, as illustrated in FIG. 11, the left and right inner side plates 31 can be electrically connected to each other through the support members 82A.

Hence, as illustrated in FIGS. 3 and 11, the photosensitive drums 11 that are grounded only to the right inner side plate 31 can be also grounded to the left inner side plate 31 through the corresponding support members 82A.

As a result, the photosensitive drums 11 can be more reliably grounded with a simple configuration.

Further, in a case where the photosensitive drums 11 are grounded only to the right inner side plate 31, electric noise is easily generated by the photosensitive drums 11.

If the photosensitive drums 11 generate electric noise, there is a concern that peripheral devices such as the scanner unit 4 may be erroneously operated by the influence thereof and hence may be broken.

However, according to the drum unit 9, the support members 82A that respectively extend in the left-right direction and are electrically connected to each of the left and right inner side plates 31 are disposed in the vicinity of the corresponding photosensitive drums 11.

Hence, electric noise generated by the photosensitive drums 11 can be reduced, and thus, erroneous operation of the peripheral devices can be suppressed.

7. Modifications

Figure 12:
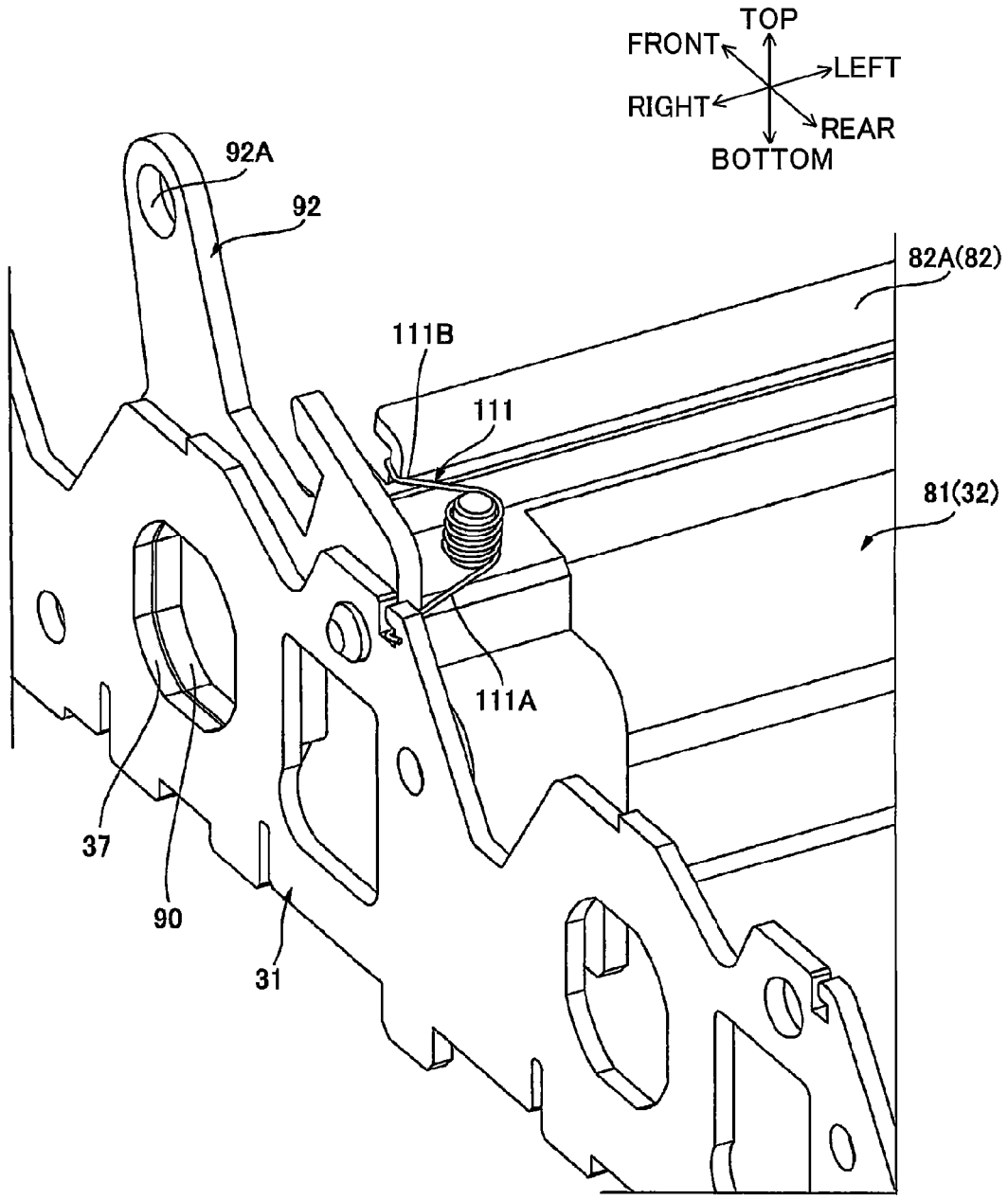
FIG. 12 is an explanatory view for explaining a modification of the drum unit.

In the above-described embodiment, the blade grounding member 80 is formed by bending a metallic plate. However, as illustrated in FIG. 12, a blade grounding member 111 may be provided in place of the blade grounding member 80. The blade grounding member 111 is configured of a coil spring formed of a metallic wire.

In this case, the blade grounding member 111 includes one end portion 111A that is engaged with the inner side plate 31, and another end portion 111B that is engaged with the support member 82A.

According to the modified example, the cleaning blade 82 can be grounded to the reference shaft 70 with a simpler configuration.

Even in this modification, the same operational advantages as the above-described embodiment can be obtained.

Figure 13:
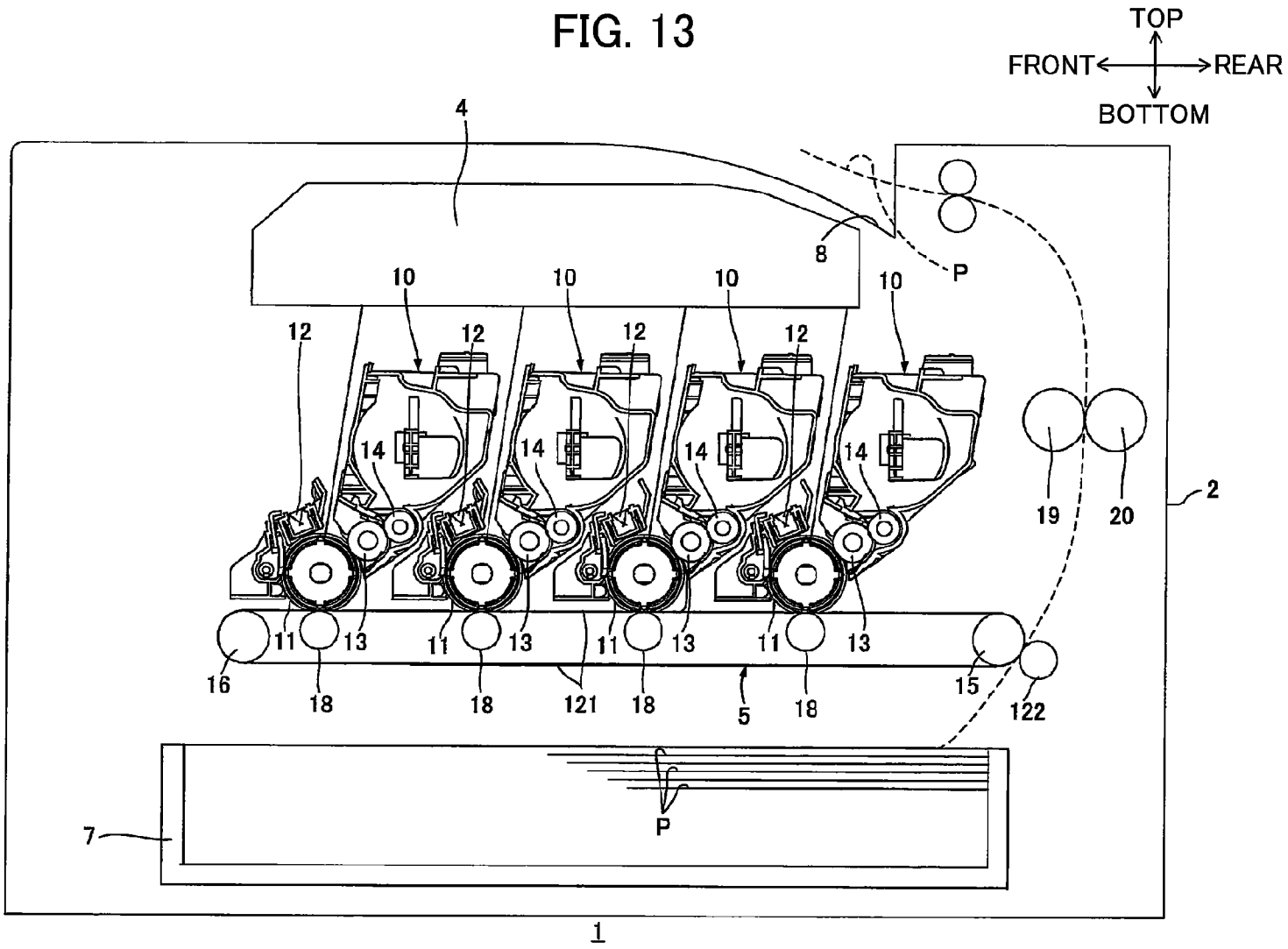
FIG. 13 is an explanatory view for explaining a modification of the image forming apparatus, in which an intermediate transfer-type image forming apparatus is shown.

Further, in the above-described embodiment, the image forming apparatus 1 is configured as the direct tandem-type color laser printer. However, for example, as illustrated in FIG. 13, the image forming apparatus 1 can be configured as an intermediate transfer-type color printer that includes an intermediate transfer belt 121 and a secondary transfer roller 122.

In this case, the intermediate transfer belt 121 circularly moves such that the upper portion thereof moves forward from the rear side during the image forming operation.

The toner images carried on the surfaces of the photosensitive drums 11 are primary-transferred onto the upper portion of the intermediate transfer belt 121 in a superposed manner, and then, conveyed in a direction from the front side to the rear side while passing through the lower side of the plurality of transfer rollers 18 by the circular movement of the intermediate transfer belt 121. Hence, the toner images are supplied between the drive roller 15 and the secondary transfer roller 122.

Meanwhile, the sheet P is conveyed diagonally above and rearward from the supply tray 7, and supplied between the drive roller 15 and the secondary transfer roller 122 at a prescribed timing.

At this time, the toner images on the intermediate transfer belt 121 are transferred onto the sheet P. The toner images on the sheet P are thermally fixed onto the sheet P as the sheet P passes between the heating roller 19 and the pressing roller 20. Subsequently, the sheet P is discharged to the discharge tray 8.

Even in this modification, the same operational advantages as the above-described embodiment can be obtained.

While the description has been made in detail with reference to the embodiments thereof, it would be apparent to those skilled in the art that many modifications and variations may be made therein without departing from the spirit of the above-described embodiment.

What is claimed is:

1. A drum unit comprising:

a photosensitive drum having an axis extending in an axial direction, the photosensitive drum comprising a surface;

a side plate having electrical conductive properties, the side plate being configured to support the photosensitive drum, the side plate comprising a contact portion configured to contact an external member having electrical conductive properties;

a cleaning member configured to clean the surface of the photosensitive drum;

a support member having electrical conductive properties and configured to support the cleaning member;

a frame having electrical insulating properties, the frame being configured to support the support member and fixed to the side plate; and a connecting member configured to electrically connect the support member to the side plate, wherein the photosensitive drum has a first end portion and a second end portion in the axial direction, wherein the side plate comprises:

a first side plate configured to support the first end portion of the photosensitive drum; and a second side plate configured to support the second end portion of the photosensitive drum, and wherein the connecting member comprises:

a first connecting member configured to electrically connect the support member and the first side plate; and a second connecting member configured to electrically connect the support member and the second side plate.

2. The drum unit as claimed in claim 1, wherein the first connecting member comprises a first fixed portion configured to be fixed to both the frame and the first side plate, and wherein the second connecting member comprises a second fixed portion configured to be fixed to both the frame and the second side plate.

3. The drum unit as claimed in claim 2, wherein the first fixed portion is plate-shaped and generally L-shaped, and wherein the second fixed portion is plate-shaped and generally L-shaped.

4. The drum unit as claimed in claim 1, wherein the first connecting member comprises a first contact portion configured to resiliently contact the support member, and wherein the second connecting member comprises a second contact portion configured to resiliently contact the support member.

5. The drum unit as claimed in claim 4, wherein each of the first contact portion of the first connecting member and the second contact portion of the second connecting member comprises:

a first portion extending inward in the axial direction; and a second portion bent in a perpendicular direction perpendicular to the axial direction at an axial end of the first portion.

6. The drum unit as claimed in claim 5, wherein the second portion has a biforked portion configured to contact the support member.

7. The drum unit as claimed in claim 1, wherein the first connecting member comprises a first wire, and wherein the second connecting member comprises a second wire.

8. The drum unit as claimed in claim 1, wherein the photosensitive drum is electrically connected to the side plate.

9. The drum unit as claimed in claim 1, wherein the first connecting member is formed of metal, and wherein the second connecting member is formed of metal.

10. The drum unit as claimed in claim 1, wherein the frame is formed of an electrical insulation resin.

11. The drum unit as claimed in claim 1, wherein the support member has a plate shape.

12. A drum unit comprising:

a first photosensitive drum having a first axis extending in an axial direction, the first photosensitive drum having a first surface;

a second photosensitive drum having a second axis extending in the axial direction, the second photosensitive drum having a second surface;

a first side plate having electrical conductive properties, the first side plate being configured to support the first and second photosensitive drums, the first side plate including a first contact portion configured to contact an external member having electrical conductive properties;

a second side plate having electrical conductive properties, the second side plate being configured to support the first and second photosensitive drums, the second side plate including a second contact portion configured to contact the external member;

a first cleaning member configured to clean the first surface of the first photosensitive drum;

a second cleaning member configured to clean the second surface of the second photosensitive drum;

a first support member having electrical conductive properties and configured to support the first cleaning member;

a second support member having electrical conductive properties and configured to support the second cleaning member;

a frame having electrical insulating properties, the frame being configured to support both the first support member and the second support member, the frame being fixed to the first side plate and the second side plate;

a first connecting member configured to electrically connect the first support member to the first side plate;

a second connecting member configured to electrically connect the first support member to the second side plate;

a third connecting member configured to electrically connect the second support member to the first side plate; and a fourth connecting member configured to electrically connect the second support member to the second side plate.

13. A drum unit comprising:

a photosensitive drum having an axis extending in an axial direction, the photosensitive drum having a first axial end portion and a second axial end portion opposite to the first axial end portion in the axial direction;

a first side plate having electrical conductive properties, the first side plate being configured to support the first axial end portion of the photosensitive drum and configured to be electrically connected to the photosensitive drum, the first side plate including a first contact portion configured to contact an external member having electrical conductive properties;

a second side plate having electrical conductive properties, the second side plate being configured to support the second axial end portion of the photosensitive drum and configured to be electrically disconnected from the photosensitive drum, the second side plate including a second contact portion configured to contact the external member; and a conducting member disposed adjacent to the photosensitive drum and configured to electrically connect the first side plate and the second side plate.

14. The drum unit as claimed in claim 13, further comprising:

a first connecting member configured to electrically connect the conducting member and the first side plate; and a second connecting member configured to electrically connect the conducting member and the second side plate.

15. The drum unit as claimed in claim 13, further comprising a cleaning member configured to clean a surface of the photosensitive drum, and wherein the conducting member is configured to support the cleaning member.

* * * * *